US006213875B1

(12) United States Patent
Suzuki

(10) Patent No.: US 6,213,875 B1
(45) Date of Patent: Apr. 10, 2001

(54) DISPLAY FOR GAME AND GAMING MACHINE

(75) Inventor: Hideyuki Suzuki, Tokyo (JP)

(73) Assignee: Aruze Corporation, Tokyo (JP)

( * ) Notice: Subject to any disclaimer, the term of this patent is extended or adjusted under 35 U.S.C. 154(b) by 0 days.

(21) Appl. No.: 09/187,098

(22) Filed: Nov. 5, 1998

(30) Foreign Application Priority Data

Nov. 5, 1997 (JP) ..... 9-302959

(51) Int. Cl.[7] ..... A63F 9/24

(52) U.S. Cl. ..... 463/20; 463/16; 273/143 R; 273/121 B

(58) Field of Search ..... 463/20, 16; 273/143 R, 273/121 B

(56) References Cited

U.S. PATENT DOCUMENTS

| | | | | |
|---|---|---|---|---|
| 4,624,459 | | 11/1986 | Kaufman | 273/143 R |
| 5,018,737 | * | 5/1991 | Okada | 273/143 R |
| 5,024,439 | * | 6/1991 | Okada | 273/143 R |
| 5,123,649 | | 6/1992 | Tiberio | 273/143 R |

FOREIGN PATENT DOCUMENTS

| | | | |
|---|---|---|---|
| 43 16 652 | 11/1994 | (DE) | G07F/17/32 |
| 0 443 738 | 8/1991 | (EP) | G07F/17/34 |
| 0 790 589 | 8/1997 | (EP) | G07F/17/32 |
| 2 170 938 | 8/1986 | (GB) | G07F/17/34 |
| 2 174 832 | 11/1986 | (GB) | G07F/17/34 |
| WO 94 01840 | 1/1994 | (WO) | G07F/17/34 |
| WO 95 08157 | 3/1995 | (WO) | G06F/19/00 |
| WO 95 22811 | 8/1995 | (WO) | G07F/17/34 |

* cited by examiner

*Primary Examiner*—Valencia Martin-Wallace
*Assistant Examiner*—Julie Kasick
(74) *Attorney, Agent, or Firm*—Rohm & Monsanto, PLC

(57) ABSTRACT

A display for game is provided with a judgment foraging whether or not a specified game state is obtained in response to a predetermined input signal, a special pattern determination for determining a special pattern that represents the specified game state, a demonstration determination for determining a demonstration by selecting from a plurality of demonstrations that indicate display modes different from usual stop motion of the special pattern, a predictive image determination for determining a predictive image by selecting from a Plurality of predictive images representing expectation degrees for appearance of the specified game state, a display for displaying the special pattern, the demonstration and the predictive image determined by the special pattern determination, the demonstration determination and the predictive image determination, respectively; and a display controller for controlling the display to indicate the predictive image determined by the predictive image determination, then to indicate the demonstration determined by the demonstration determination and to indicate the special pattern determined by the special pattern determination, wherein each of the plurality of demonstrations represents an expectation degree for appearance of the specified game state, the expectation degree being varied according to a combination of the demonstration and the predictive image. A player expects appearance of a special pattern with the expectation degree represented by the predictive image on looking at the predictive image firstly indicated, and then expects appearance of a special pattern with the expectation degree represented by the demonstration on looking at the demonstration which is thereafter indicated. The expectation degree of the demonstration is not always identical because it is varied depending on the combination of the demonstration and the predictive image indicated just before.

20 Claims, 19 Drawing Sheets

FIG.6

I (IN CASE OF FOUR KINDS OF PREDICTIVE IMAGE)

| | | PREDICTIVE IMAGE | | | |
|---|---|---|---|---|---|
| | | A | B | C | D |
| DEMONSTRATION DETERMINATION MEANS (DEMONSTRATION DETERMINATION & JUDGEMENT RESULT OF "BIGHIT") | ① DEMONSTRATION 1 & BIG HIT | 7/10 | 1/10 | 1/10 | 1/10 |
| | ② DEMONSTRATION 2 & BIG HIT | 1/10 | 7/10 | 1/10 | 1/10 |
| | ③ DEMONSTRATION 1 & LOOS | 1/10 | 1/10 | 7/10 | 1/10 |
| | ④ DEMONSTRATION 2 & LOSS | 1/10 | 1/10 | 1/10 | 7/10 |
| | ⑤ DEMONSTRATION NOTHING & LOSS | 2/10 | 2/10 | 3/10 | 3/10 |

II (IN CASE OF TWO KINDS OF PREDICTIVE IMAGE)

| | | PREDICTIVE IMAGE | |
|---|---|---|---|
| | | A | B |
| DEMONSTRATION DETERMINATION MEANS (DEMONSTRATION DETERMINATION & JUDGEMENT RESULT OF "BIGHIT") | ① DEMONSTRATION 1 & BIG HIT | 7/10 | 1/10 |
| | ② DEMONSTRATION 2 &BIG HIT | 1/10 | 7/10 |
| | ③ DEMONSTRATION 1 & LOSS | 1/10 | 1/10 |
| | ④ DEMONSTRATION 2 & LOSS | 1/10 | 1/10 |
| | ⑤ DEMONSTRATION NOTHING & LOSS | 5/10 | 5/10 |

NOTE : 1) Above "%" shows probability expectation degree of "BIGHIT"

(PROCESS IN FIRST CONTROLLER)

(PROCESS IN SECOND CONTROLLER)

FIG. 17
(A)
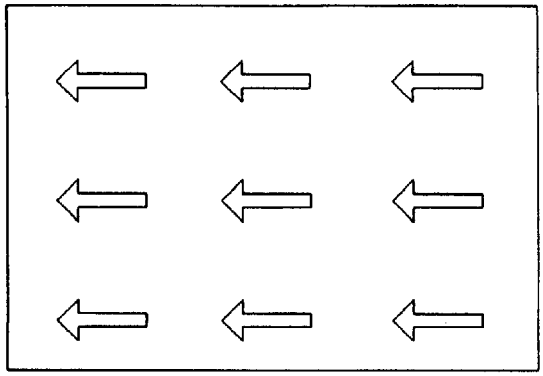
(B)
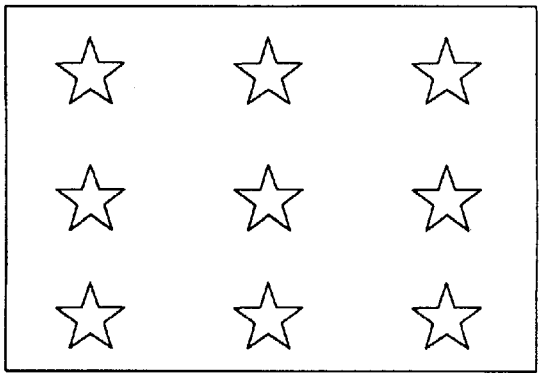
(C)
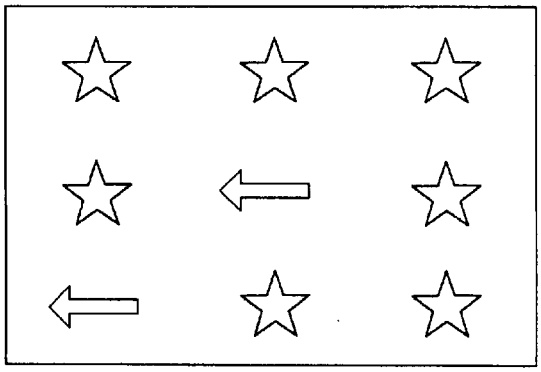
(D)
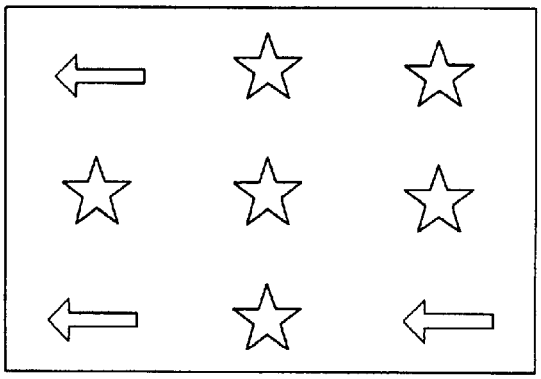

DISPLAY FOR GAME AND GAMING MACHINE

BACKGROUND OF THE INVENTION

This invention relates generally to displays for games, and more particularly for a game used for a gaming machine such as a ball-shooting game machine (e.g. pachinko game machine), a slot machine or a TV game machine.

RELATED ART

In a pachinko game machine, for example, a mechanical display of the type that includes reels has hitherto been used as a display for a game that profits, or awards a player when a pattern that is indicated by the display is arranged to produce a predetermined combination of symbols. In recent years, however, an electrical display, such as liquid crystal display, has become popular due to the possibility of multiple demonstration effects. Further, a known slot machine or the like that does not employ a game ball does not use a mechanical display with rotating reels, but instead employs an electrical display formed of a crystal or a CRT.

Such electrical displays achieve game indications that cannot be realized by conventional mechanical displays. It therefore becomes possible to produce various indications or demonstrations that increase the interest of a player in the game being played. For example, a real-time indication of: the times during which a variable winning device is available to be converted into an open sate that is profitable for the player when the variable display is stopped in a specified combination of symbols (e.g. "big hit"); a real-time indication of number of game balls that entered in the variable winning device; an indication of a background in a different color from usual when the display indicates a specified pattern in order to demonstrate the big hit excitingly; an indication of the appearance of new characters other than the symbols (or special pattern) used for the game; an indication of a pattern with unusual motion when the game is in a state in which the big hit can be obtained if one or more special symbols will be arranged in the display (that is, a "reach" state), thereby enabling the player to recognize that a "big hit" will appear soon; as well as indications of other game conditions.

One particularly useful demonstration for raising the interest level of a player is a pattern change indication called a "reach action" in the "reach" state. When the reach action begins a player pays attention to the indication on the display with the expectation of an appearance of a "big hit" in the principal game. The reach action includes, for example, a change of speed of pattern variation (variable display) as compared with usual speed of pattern variation in the principal game, a change of time of pattern variation or the like, and sometimes, the "big hit" appears with certainty in response to a special reach action. Thus, a reach action is an indication that will make a player expect the appearance of a "big hit."

The reach action on a display of a conventional gaming machine may convince the player of the impending appearance of the big hit by a relatively simple change of speed or the timing of a pattern variation. Since the big hit may not always appear, it may betray the player's expectation and reduce player's interest in the game. Further, as mentioned above, it is known that the reach action is carried out by indicating a symbol (or a character) other than the symbols used in the special pattern. The conventional reach action is only a simple symbol indication without any information concerning the possibility of the appearance of a big hit. In any case, a player easily tires of the conventional simple reach action, and thus the game may become monotonous.

With the foregoing in mind, it could be proposed that a pattern or symbol for the principal (special pattern) that is indicated by the display be utilized to execute the reach action using a combination of the special patterns or symbols. However, a special pattern or symbol would be regulated by the rules of the principal game. As a result, the number and kind of symbols or patterns cannot be increased to achieve a reach action independently of the indication used for the principal game. Even if the increase can be accomplished, it is necessary to prepare the combinations of symbols for the predictive display as additions to the combinations of symbols used for the principal game, thereby resulting in a problem in that the indication control of the special pattern becomes very complicated.

SUMMARY OF THE INVENTION

An object of this invention is to provide a display for a game, the display providing information relating to the probability of the appearance of a big hit to a player and information relating to the expectation that a profitable combination of predictive images and a reach action in the game, by varying the degree of expectation of a big hit in such a manner that a combination of the predictive images consisting of combined symbols with a plurality of reach actions corresponds to a special pattern (big hit), without increasing the kind or number of patterns or symbols used in the principal game and without making the display control unduly complicated.

Another object of this invention is to proved a gaming machine that utilizes the principle of the display for the game mentioned above.

In accordance with the invention, there is provided a display for a game having a judgment arrangement for determining whether a specified game state is to be obtained in response to a predetermined input signal; a special pattern determination arrangement for determining a special pattern that represents the specified game state; a demonstration determination arrangement for determining a demonstration by selecting from a plurality of demonstrations that indicate display modes different from usual stop motion of the special pattern; a predictive image determination arrangement for determining a predictive image by selecting from a plurality of predictive images representing different degrees of expectation of the appearance of the specified game state; a display for displaying the special pattern, the demonstration, and the predictive image determined by the special pattern determination, the demonstration determination arrangement and the predictive image determination arrangement respectively; and a display controller for controlling the display to indicate the predictive image determined by the predictive image determination arrangement, the demonstration determined by the demonstration determination arrangement, and the special pattern determined by the special pattern determination arrangement. In this display, each of the demonstrations represents a degree of expectation of the appearance of the specified game state, the degree of expectation being varied according to a combination of the demonstration and the predictive image.

The judgment arrangement determines whether or not a specified game state (for example, a big hit) is to appear in response to a predetermined input signal.

Based on the result of the determination by the judgment arrangement, the special pattern determination arrangement determines a special pattern to represent a the specified game state (a combination of the symbols of the big hit).

The demonstration determination arrangement determines a demonstration to be indicated, or displayed, by selecting from a plurality of demonstrations that indicated the display mode of the stop motion of the special pattern being made different from usual. This determination includes a determination not to display any demonstration.

The predictive image determination arrangement determines a predictive image that is to be indicated by selecting from a plurality of predictive images each having a corresponding degree of expectation of the appearance of the special pattern mentioned above.

The display controller controls the display so as to indicate first the predictive image determined by the predictive image determination arrangement, then the demonstration determined by demonstration determination arrangement, and finally the special pattern determined by the special pattern determination arrangement.

A player expects the appearance of a special pattern with the degree of expectation represented by the predictive image upon seeing the predictive image firstly indicated, and then the player expects the appearance of a special pattern with the degree of expectation represented by the demonstration, upon seeing the demonstration which is thereafter indicated.

However, the degrees of expectation associated with the respective demonstrations are not always identical because they vary depending on the combination of the demonstration and the previously indicated predictive image. The player must therefore memorize the previously indicated predictive image and to judge the degree of expectation represented by the demonstration being indicated. Thus, complexity that is produced by the change in the degree of expectation represented by the demonstration causes the player to develop much interest in the game.

Further, when the predictive image has been indicated, the player waits with anticipation and interest in the game for a demonstration that will be indicated thereafter.

If the expectations that are represented by the predictive image and the demonstration are expectations for the appearance of a big hit of the type that give s the player the biggest profit among those given by the special patterns, the player has an increased interest in the indication of the predictive image and the demonstration.

In accordance with the invention, there is also provided a display for a game having: a judgment arrangement for determining whether a specified game state is obtained under a first condition in response to a predetermined input signal; a special pattern determination arrangement for determining a special pattern that represents the specified game state based on a result of the judgment; a demonstration determination arrangement for determining a demonstration that is different from a usual stop motion of the special pattern, based on the result of the judgment and a second condition; a predictive image determination arrangement for determining a predictive image to indicate a degree of expectation of the appearance of the specified game state, based on a result of demonstration determination arrangement and the predictive image demonstration determination, respectively; and a display controller for controlling the display to indicate the predictive image determined by the predictive image determination arrangement, then the demonstration determined by the demonstration determination arrangement, and to indicate the special pattern determined by the special pattern determination arrangement.

The judgment arrangement determines under the first condition whether or not a specified game state (for example, a big hit) is to be displayed in response to a predetermined input signal.

Based on the result of the judgment, the special pattern determination arrangement determines a special pattern to represent a special pattern showing the specified game state (a combination of symbols of the big hit).

The demonstration determination arrangement determines, based on the result of the judgment and the second condition, a demonstration to be displayed by selecting from a plurality of demonstrations that are different from a usual stop motion of the special pattern. The determinations include a determination not to indicate any demonstration.

The predictive image determination arrangement determines, based on the result of the determination by the demonstration determination and the third condition, a predictive image that is to be displayed by selecting from a plurality of predictive images that represent respective degrees of expectation of the appearance of the special pattern mentioned above.

The display controller controls the display so as to indicate the predictive image determined by the predictive image determination arrangement, then the demonstration determined by demonstration determination arrangement, and finally the special pattern determined by the special pattern determination arrangement.

The first condition, the second condition, and the third condition may be predetermined, for example, to correspond to the values of first, second, and third random numbers optionally sampled from random numbers generated by a random number generator that are coincident with respective predetermined values.

In this case, if the first condition is preset as the value of the first random number that is sampled in response to the predetermined input signal from the random numbers that are generated by the random number generator, and if such is coincident with a predetermined value, the judgment arrangement will determine whether or not a specified game state is to be displayed by determining whether or not the value of the random number is coincident with the predetermined value. If the second condition is preset as the value of second random umber sampled responding to the predetermined input signal is coincident with a predetermined value, the demonstration determination can determine a demonstration that is responsive to the value of the random number. If the third condition is present as the value of the third random number sampled in response to the predetermined input, and if such signal is coincident with a predetermined value, the predictive image determination arrangement can determine a predictive image that is responsive to correspond to the value of the random number.

The first, second, and third random numbers are sampled in response to different input signals, respectively the sampling times can be made different each other. As a result, the same combination of a special pattern, a demonstration, and a predictive image is seldom produced thereby and the displayed image, pattern, or symbol can consequently be distinguished easily.

The player can expect the type of special pattern that is indicated to be finally, by watching the predictive image that is indicated first and the demonstration and the demonstration indicated thereafter, because the predictive image that is indicated before the demonstration is determined in response to the result of the judgment and the determination result of the demonstration determination arrangement mentioned above, as well as the third condition.

For example, the player expects the big hit with 100% certainty at the time the player views the predictive image representing the degree of expectation corresponding to certainty of the big hit.

On the other hand, the player will expect the big hit with a 50% degree of expectation when the predictive image corresponds to the degree of expectation corresponding to 50%. However, when the demonstration presented thereafter represents a 100% certainty of expectation of the appearance of the big hit due to the combination of the demonstration and a predictive image previously displayed, the player can expect the big hit with certainty when he sees such demonstration, though he had expected the big hit by a degree of only 50% at the time he had viewed the predictive image.

As mentioned above, according to this invention, the degree of expectation of the appearance of the big hit can be varied.

The player can estimate the degree of expectation, or the possibility, of the appearance of a special pattern that would result in an award to the player by recognizing the demonstration indicated as being connected to the previously presented predictive image.

The player's feeling of expectation at the time when the player views the predictive image is raised by watching the demonstration. The expectation will rarely be betrayed, thereby permitting the player to concentrate his attention on successive appearance of the special pattern.

As mentioned above, tin addition to viewing the display of the predictive image, the player can attempt to predict the type of special pattern that will appear in response to the degree of probability associated with the demonstration that has been displayed.

The probability of the appearance of special pattern representing a specified game state is decided by a combination of the demonstration with the predictive image, resulting in a variation of the probability of the appearance of the big hit special pattern that will award the player. Consequently, the player can enjoy a game by looking for a predictive image or a demonstration associated with a high probability of appearance of the big hit, and additionally can enjoy the principal game with greater interest.

In accordance with the invention, there is further provided a display for a game having: a random number generator for generating three random numbers in response to a predetermined input signal; a judgment arrangement for determining whether or not a specified game state is achieved, based on a first random number generated by the random number generator; a demonstration determination arrangement for determining a demonstration that is different from a usual stop motion of a special pattern representing the specified game state, based on a result of the determination by the judgment arrangement and a second random number generated by the random number generator; a special patter selection table for storing a plurality of the special patterns; a special pattern selection arrangement for selecting the special pattern to be displayed from the special pattern selection table, based on the result of the determination by the judgment arrangement; a demonstration image selection table for storing a plurality of demonstration images required for displaying the demonstration; a demonstration image selection arrangement for selecting the demonstration image required for displaying the demonstration determined by the demonstration determination from the demonstration image selection table; a predictive image selection table for storing a plurality of predictive images representing degrees of expectation of the appearance of the specified game state; a predictive image selection arrangement for selecting the predictive image to be displayed from the predictive image selection table, based on the result of the demonstration determination and a third random number generated by the random number generator; a display for displaying the special pattern, the demonstration image and the predictive image determined by the special pattern selection, the demonstration image selection arrangement and the predictive image selection arrangement, respectively; and a display controller for controlling the display to indicate the predictive image determined by the predictive image determination arrangement, then the demonstration determined by the demonstration determination arrangement and for indicating the special pattern determined by the special patter determination arrangement.

The display for the game according to an embodiment of the invention further includes a memory for storing a plurality of predetermined symbols, and the special pattern determination arrangement will produce the special pattern by combining the symbols stored in the memory according to the result of the determination by the judgment arrangement.

In accordance with the invention there is provided a gaming machine having: a arrangement for determining whether or not a specified game state is achieved in response to a predetermined input signal; a special pattern determination arrangement for determining a special pattern to represent the specified game state; a demonstration determination arrangement for determining a demonstration by selecting from a plurality of demonstrations that indicate display modes different from a usual stop motion of the special pattern; a predictive image determination arrangement for determining a predictive image by selecting from a plurality of predictive images representing degrees of expectation for the appearance of the specified game state; a display for displaying the special pattern, the demonstration and the predictive image determined by the special patter determination arrangement, the demonstration determination and the predictive image determination, respectively; and a display controller for controlling the display to indicate the predictive image determined by the predictive image determination arrangement, then the demonstration determined by the demonstration determination arrangement, and to indicate the special pattern determined by the special pattern arrangement. In this gaming machine, each of the plurality of demonstrations represents a respective degree of expectation for the appearance of the specified game state, the degree of expectation being varied according to a combination of the demonstration and the predictive image.

In accordance with the invention, there is also provided a gaming machine having: a judgment arrangement for determining whether or not a specified game state is obtained under a first condition in response to a predetermined input signal; a special pattern determination arrangement for determining a special pattern to represent the specified game state based on a result of the judgment; a demonstration determination arrangement for determining a demonstration that is different from a usual stop motion of the special pattern, based on the result of the determination made by the judgment arrangement and a second condition; a predictive image determination arrangement for determining a predictive image to indicate a degree of expectation of the appearance of the specified game state, based on a result of the demonstration determination arrangement and a third condition; a display for displaying the special pattern, the demonstration and the predictive image determined by the special pattern determination arrangement, the demonstration determination arrangement and the predictive image demonstration determination arrangement, respectively; and a display controller for controlling the display to indicate the predictive image determined by the predictive image determination arrangement, then the demonstration determined by the demonstration determination arrangement, and to indicate the special pattern determined by the special pattern determination arrangement.

The gaming machine according to the invention may, in certain embodiments further be provided with a memory for storing a plurality of predetermined symbols, and the special pattern determination arrangement can produce the special pattern by combining the symbols stored in the memory according to the result of determination made by the judgment arrangement.

BRIEF DESCRIPTION OF THE DRAWINGS

The foregoing and other objects, features, and advantages of the invention will become more apparent from the following detailed description taken in conjunction with the accompanying drawings, in which:

FIG. 6 is a list that shows the probabilities of the appearance of the predictive images corresponding to combinations of the judgment and demonstration determination results;

FIG. 17 is a representation that illustrates examples of the predictive image;

PREFERRED EMBODIMENT OF THE INVENTION

Figure 1:
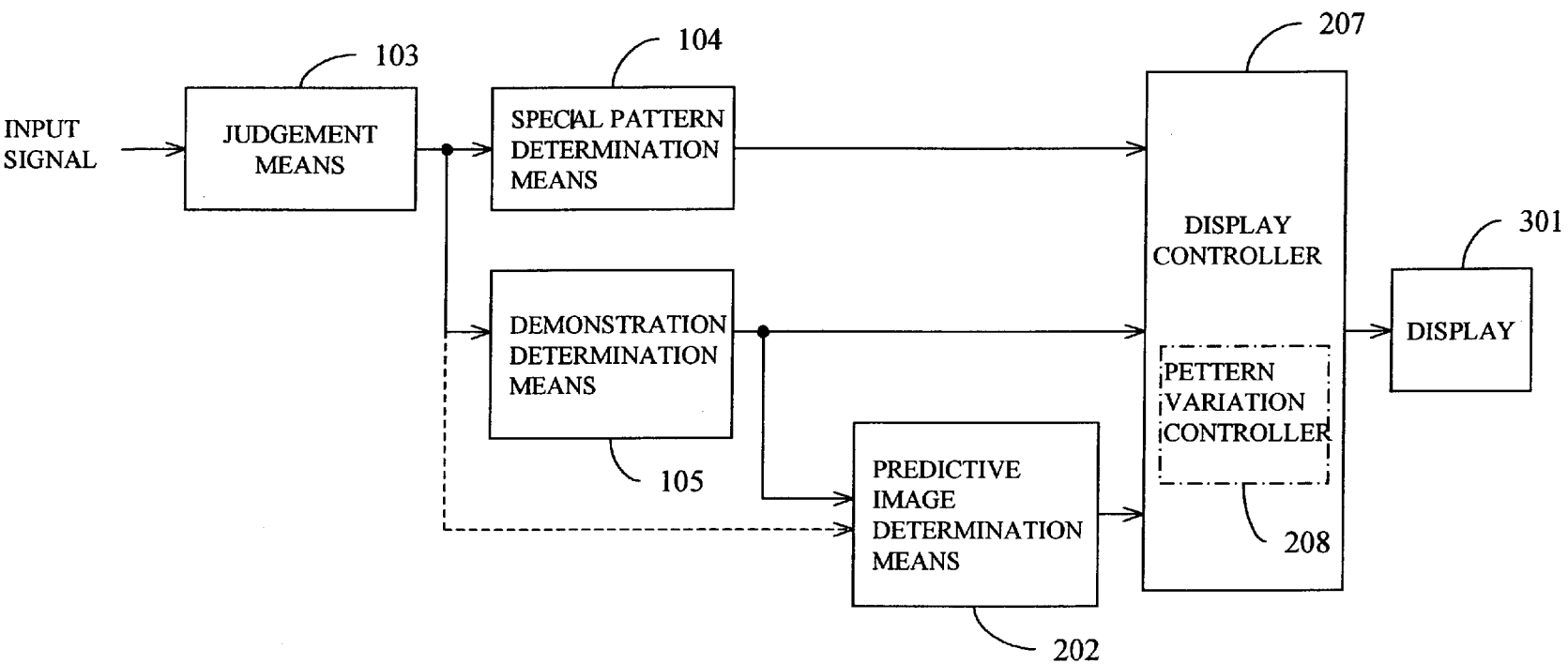
FIG. 1 is a block diagram that illustrates a first embodiment of the display for the game of this invention.

FIG. 1 shows the fundamental constitution of the display apparatus for a game according to the invention. The constitution includes:

- a judgment mean 103 to determine whether or not a specified game state is achieved in response to a predetermined input signal,
- a special pattern determination means 104 to determined a special pattern to represent the specified game state,
- a demonstration determination means 105 to determine a demonstration by selecting one of a plurality of demonstrations that indicate display modes different from a usual stop motion of the special pattern,
- a predictive image determination means 202 for determining the selection of a predictive image from a plurality of predictive images representing degrees of expectation for the appearance of the specified game state,
- a display device 301 for indicating, or displaying, the special pattern, the demonstration and the predictive image determined by the special pattern determination means 104, the demonstration determination mean 105, and the predictive image determination 202, respectively, and
- a display controller 207 for controlling the display device 301 to indicate the predictive image determined by the predictive image determination mean 202, then to indicate the demonstration determined by the demonstration determination mean 105, and to indicate the special pattern determined by the special pattern determination means 104.

In the display, each of the plurality of demonstrations represents a degree of expectation for the appearance of the specified game state, the degrees of expectation being changed by a combination of the predictive image.

In the above arrangement, the special pattern determination means 104 determines a type of special pattern to indicate the specified game state by the judgment means 103. On the other hand, the demonstration determination means 105 determines a type of demonstration that is to be indicated in the display mode and which has a movement that is different from the movement that the special pattern exhibits in the principal game state stops in response to judgment means 103. The degree of expectation for the appearance of the "big hit" which in this demonstration is shown to response to a combination that includes the predictive image determined by the predictive image determination means 202. The predictive image determined by the predictive determination means 202. The predictive image determination means 202 determines a type, or kind, of the predictive image based on the result of the determination made by the demonstration determination means 105 that should indicate it. In other words, it is possible for a player who has recognized the predictive image and a combination with the demonstration indicated to predict the "big hit" because the degree of expectation for the appearance of "big hit" is shown by the combination pattern with the predictive image and the demonstration. The determination of the kind of predictive image is not based on the result of the determination by the demonstration determination means 105 and is shown with a dashed line of FIG. 1, and based on the determination by the judgment means 103, may be determined in addition to the above.

In the above reference arrangement, a CPU which is used as the control means of a game machine can execute the functions of the judgment means 103, the special pattern determination means 104, the demonstration determination means 105, the predictive image determination means 202, and the display controller 207.

Figure 2:
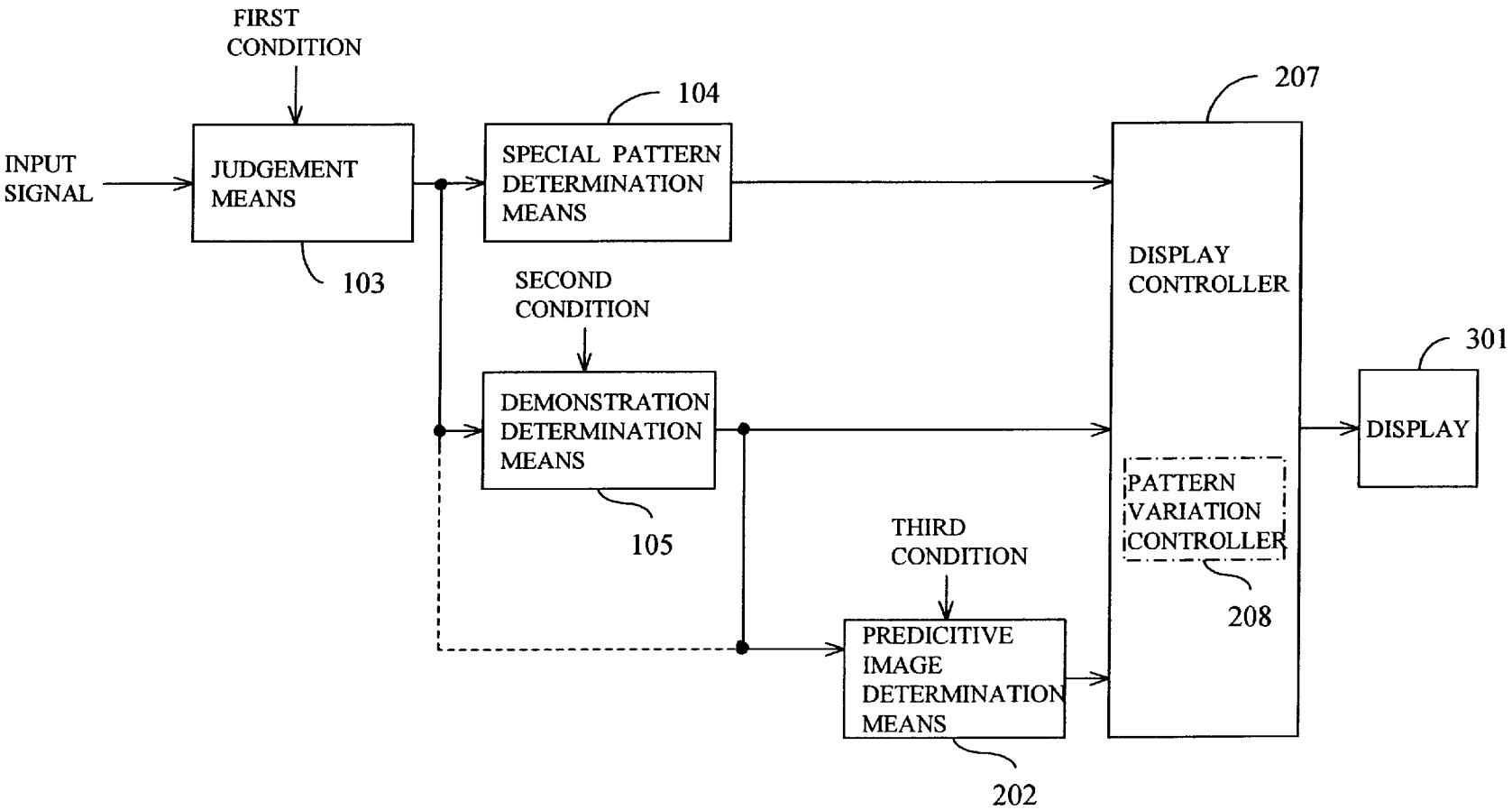
FIG. 2 is a block diagram that illustrates a second embodiment of the a display for the game of this invention.

FIG. 2 shows an arrangement of a display unit for a game constructed according to the second embodiment of the invention. Here, the same references are referred to the same elements in FIG. 1.

The arrangement includes:

- a judgment means 103 for determining whether or not a specified game state is achieved under a first condition in response to a predetermined input signal,
- a special pattern determination means 104 for determining a special pattern to represent the specified game state based on the result of the determination by mean 103,
- a demonstration determination means 105 for determining a demonstration that is different from a usual stop motion of the special pattern, based on the judgment result by the judgment means 103 and a second condition,
- a predictive image determination means 202 for determining a predictive image to indicate a degree of expectation in the appearance of the specified game state, based on the determination result by the demonstration determination means 105 and a third condition,
- a display device 301 for indicating the special pattern, the demonstration and the predictive image determined by the special pattern determination means 104, the demonstration determination means 105 and the predictive image determination means 202, respectively, and
- a display controller 207 for controlling the display 301 to indicate the predictive image determined by the predictive image determination means 202, then the demonstration determined by the demonstration determination mean 105, and to indicate the special pattern determined by the special pattern determination means 104.

In the above constitution, the special pattern determination means 104 determines a special pattern that indicates the game state specified by the judgment means 103. For example, it is shown by a combination such as 7-7-7,7-7-6, •••, 6-6-6, •••, and it also can be shown by characters, patterns, and a combination of other patterns. On the other hand, the demonstration determination means 105 is based on the determination made by the judgment means 103 mentioned above and the second condition and determines a kind of demonstration indicated by the display mode to be different from the movement that the special pattern in the usual game state stops. Furthermore, predictive image determination means 202 is responsive to determination result with the demonstration determination means 105 mentioned above and the third condition and determines the predictive image representing the probability that the standstill mode of the special pattern will correspond to the "big hit."

Accordingly, the player can predict whether the standstill mode of the special pattern becomes the "big hit" that may bring an advantageous game state for the player from the demonstration and the combination with the predictive image indicated before the standstill of special pattern. The predictive image can be determined, not based on the determination result of the demonstration determination means 105, but instead on the determination of the judgment means 103 and the third condition as shown by a dashed line in FIG. 2.

Figure 3:
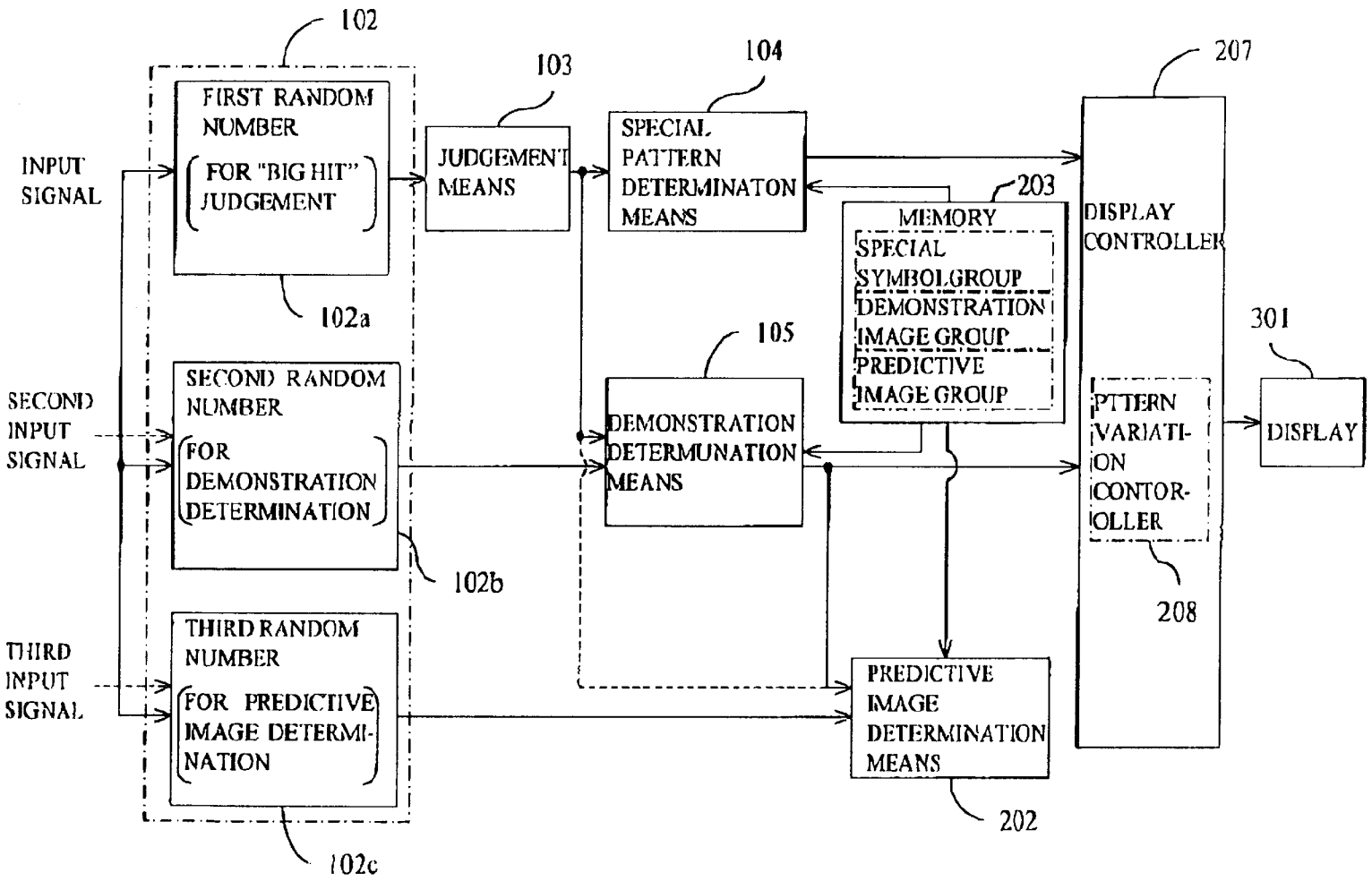
FIG. 3 is a block diagram that illustrates a third embodiment of a display for the game of this invention.

FIG. 3 shows a display for a game as another embodiment of the invention. Here, the same references are referred to the same elements in FIGS. 1 and 2.

The arrangement includes:

- a random number generator 102 for generating three random numbers in response to the predetermined input signal,
- a judgment means 103 for determining whether or not a value of the first random number generated by the random number generator 102 is a predetermined one corresponding to the specified game state,
- a memory 203 for storing a special pattern group that indicates the specified game state, a demonstration image group that indicates the demonstration different from the movement that the special pattern in the usual game state stops, and a predictive image group that indicates the expectation degree of the specified game state,
- a special pattern determination means 104 for determining a special pattern by selecting one from the special pattern group stored in the memory 203, based on the determination made by the judgment means 103,
- a demonstration determination means 105 for determining a demonstration image by selecting one from the demonstration image group stored in the memory 203, based on the determination made by the judgment means 103 and a value of the second random number generated by the random number generator 102,
- a predictive image determination means 202 for determining a predictive image by selecting one from the predictive image group stored in the memory 203, based on the determination result by the demonstration determination means 105 and a value of the third random number generated by the random number generator 102,
- a display device 301 for indicating the special pattern, the demonstration and the predictive image determined by the special pattern determination means 104, the demonstration determination means 105 and the predictive image determination means 202 determination, respectively, and a display controller 207 for controlling the display device 301 to indicate the predictive image determined by the predictive image determination means 202, then the demonstration determined by the demonstration determination means 105, and to indicate the special pattern determined by the special pattern determination means 104.

In the above arrangement the random number generator 102 has the first, second, and third random number generation circuits 102*a*, 102*b* and 102*c*, each of which generates a random number according to the input signal. When a signal is input, these three random numbers may be generated all a once or may be generated independently in time. Also, the second and third random numbers may be generated, not by one input signal, but instead in response to the second and third input signals, respectively, as shown by a dashed line in FIG. 3. In this case, as several different input signals can be used. For example, signals generated, when a game ball enters into a starter hole or other winning hole, or when symbols start to vary in a pachinko game machine as mentioned later, can be used.

The judgment means 103 determines whether or not a value of the first random number generated from the first random number generation circuit 102*a* is a predetermined value. Based on the determination by judgment means 103, the special pattern determination means 104 determines the special pattern to be displayed from the special pattern group stored in the memory 203. Based on the result by the demonstration determination means 105 and a value of the third random number value generated from the third random number generation circuit 102*c*, the predictive image determination means 202 selects the predictive image to be displayed from the predictive image group stored in the memory 203. Accordingly, the predictive image can be indicated in response to a combination of the special pattern and the demonstration determined. In other words, when the special pattern is determined to form a combination of symbols representing the "big hit", a combination of the predictive image and the demonstration is easily determined to form a combination of symbols for predicting the "big hit" to a player. The predictive image may be selected based on the judgment result by the judgment means 103 and a value of the third random number generated from the third random number generation circuit 102*c*, as shown by a dashed line in FIG. 3.

The display controller 207 controls the display 301 to indicate the predictive image determined, then the demonstration image is determined, and to indicate last the special pattern determined as mentioned above. Thus, the player can predict what kind of special pattern will be displayed according to the combination of the predictive image and the demonstration indicated.

Figure 4:
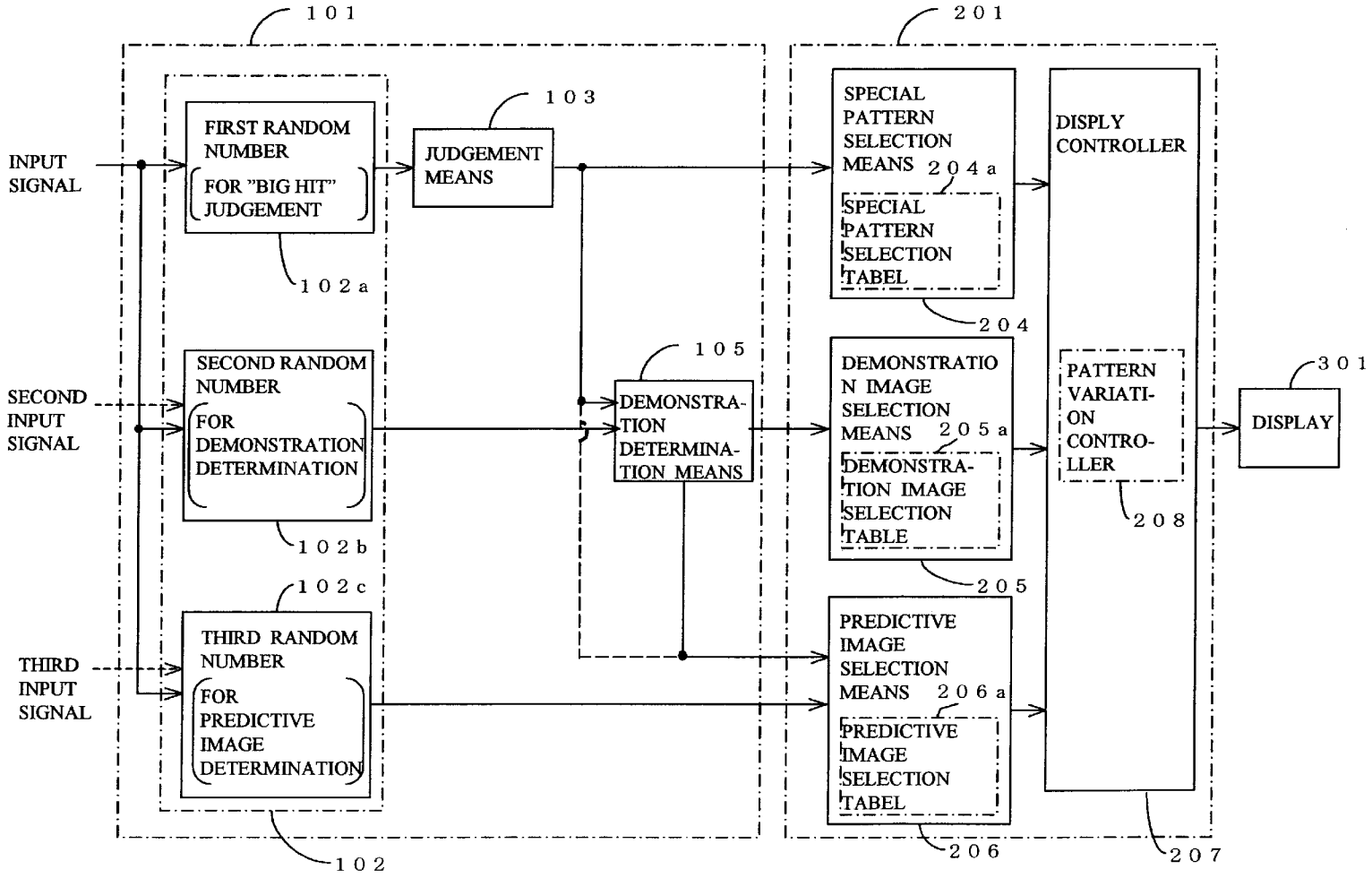
FIG. 4 is a block diagram that illustrates a fourth embodiment of a display for the game of this invention.

Next, FIG. 4 shows a display apparatus for a game according to another embodiment. Here, the same references are referred to the same elements in g FIGS. 1, 2, and 3.

This arrangement includes:

a random number generator 102 for generating three random numbers in response to a predetermined input signal, a judgment means 103 for determining whether or not a value of the first random number generated by the random number generator 102 is a predetermined value, a demonstration determination means 105 for determining a demonstration that is different from the stop mode of the special pattern in the usual game state, based on a value of the second random number generated by the random number generator 102 and the determination made by the judgment means 103, a special pattern selection table 204*a* for storing a special pattern group indicating the specified game state, a special pattern selection means 204 for selecting a special pattern to be display form the special pattern selection table 204*a*, based on the determination by the judgment means 103, a special pattern selection table 204*a* for storing a special pattern group indicating the specified game state, a special patter selection means 204 for selecting a special pattern to be displayed from the special pattern selection table 204*a*, based on the determination by the judgment means 103, a demonstration image selection table 205*a* for storing a demonstration image group to indicate the demonstration, a demonstration image selection means 205 for selecting a demonstration image from the demonstration image selection table 205*a*, based on the determination result of the demonstration determination means 105, a display controller 207 including a pattern variation controller 208 for controlling the display of the predictive image selected by the predictive image selection means 208, the variation of the special pattern, the demonstration selected by the demonstration selection means 205, and the standstill indication of the special pattern selected by the special pattern selection means 204, and a display device 301 for displaying the special pattern selected by special pattern selection means 204, the demonstration image selected by demonstration image selection means 205, and the predictive image selected by the predictive image selection means 206 according to an instruction of the display controller 207.

In the above arrangement, functions of each means other than the display 301 can be executed in one controller (CPU). Two controllers can be used instead of the one controller. For example, the first controller 101 may consist of the random number generator 102, the judgment means 103 and the demonstration determination means 105, and the second controller 102 may consist of the special pattern selection means 204, the demonstration selection means 205, the predictive image selection means 206 and the display controller 207. This achieves the advantage of reducing a load of a single controller rather than having the controller execute all of the functions.

In the arrangement of FIG. 4, the random number generator 102 has the first, second and third random number generation circuits 102*a*, 102*b*, 102*c*, each of which generates a random number according to the input signal. These random numbers may be generated all at once or each differently in time when a signal is input. In other embodiments, the three random numbers are not generated in response to a common input signal, but instead the second and third random numbers may be generated responding to the second and third input signals, respectively, as shown by a dashed line of FIG. 3. In this case, for example, one can use a plurality of different input signals, such as the signals that are generated when a game ball enters into a starter hole or other winning hole, or when symbols start to vary in a pachinko gaming machine as will be mentioned later.

The special pattern group stored in the special symbol selection table 204*a*, the demonstration image group stored in the demonstration image selection table 205*a*, and the predictive image group stored in the predictive image selection table 206*a* have the following arrangement:

The special patterns are stored as symbols which represent numbers, characters, patterns, or the combinations thereof, such as "7-7-7" (big hit), "7-7-6", •••, "7-7-5", •••, "6-6-6", •••. The special pattern group consisting of a combination of the special patterns represented by these symbols is stored in the special pattern selection table 204*a*. The demonstration images are stored in the demonstration image selection table 205*a* as several symbols (combination) corresponding to the demonstrations such as "demonstration1 outbreak", "demonstration2 outbreak", no demonstration outbreak" determined by the demonstration determination means 105.

Figure 5:
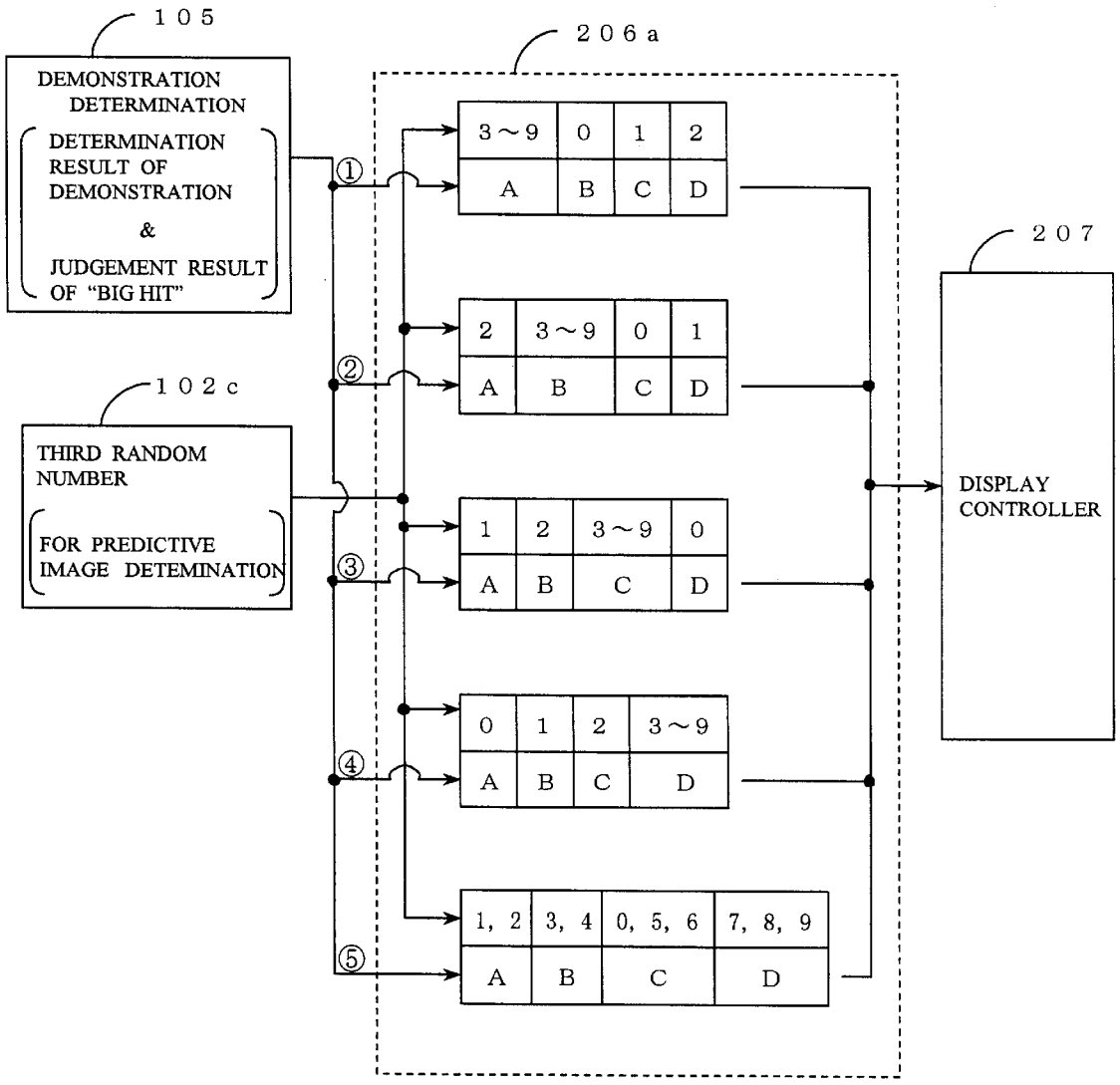
FIG. 5 is a block diagram that illustrates constitution of the predictive image selection means of FIG. 4.

FIG. 5 shows an illustrative embodiment of the predictive image selection table 206*a*. In this selection table, a plurality of predictive images (A, B, C, D) correspond to combinations ① to ⑤ with the determination result ("big hit" or not) by the judgment means 103 and the determination result (kind of the demonstration) by the demonstration determination means 205. These predictive images (A, B, C, D) are assigned to ranges of value of the third random number. As for the combinations ① and ⑤, the combination ① is "demonstration 1 & big hit", ② is "demonstration 2 & big hit", ③ is "demonstration 1 & loss", ④ is "demonstration 2 & loss", and ⑤ is "demonstration nothing & loss", as shown in FIG. 5. In other words, any of the combinations ① to ⑤ is determined in the demonstration determination means 105, and one of the predictive images A, B, C, and D (in case of four kinds) to be displayed is selected according to a value of the third random number. For example, the predictive image "A" is selected when the combination ① (demonstration 1 & big hit) is determined in the demonstration determination means 203 and if a value of the third random number is "5."

According to the above arrangement, the predictive image is selected in the probability as shown in FIG. 6 (I) from a relation of the values of the third random number and the predictive images A, B, C, D in predictive image selection table 206*a*. For example, a player anticipates an appearance of "big hit" by indication of the predictive image "A" because "⑤ demonstration 1 & big hit" appears with a probability of 70% in the table when predictive image "A" is indicated.

In other word, the predictive images, A, B, C, D are selected in probabilities of 70%, 10%, 10%, 10%, respectively, according to the values of the third random number, when a determination result of the demonstration determination means 105 is "① demonstration 1 & big hit."

Figure 7:
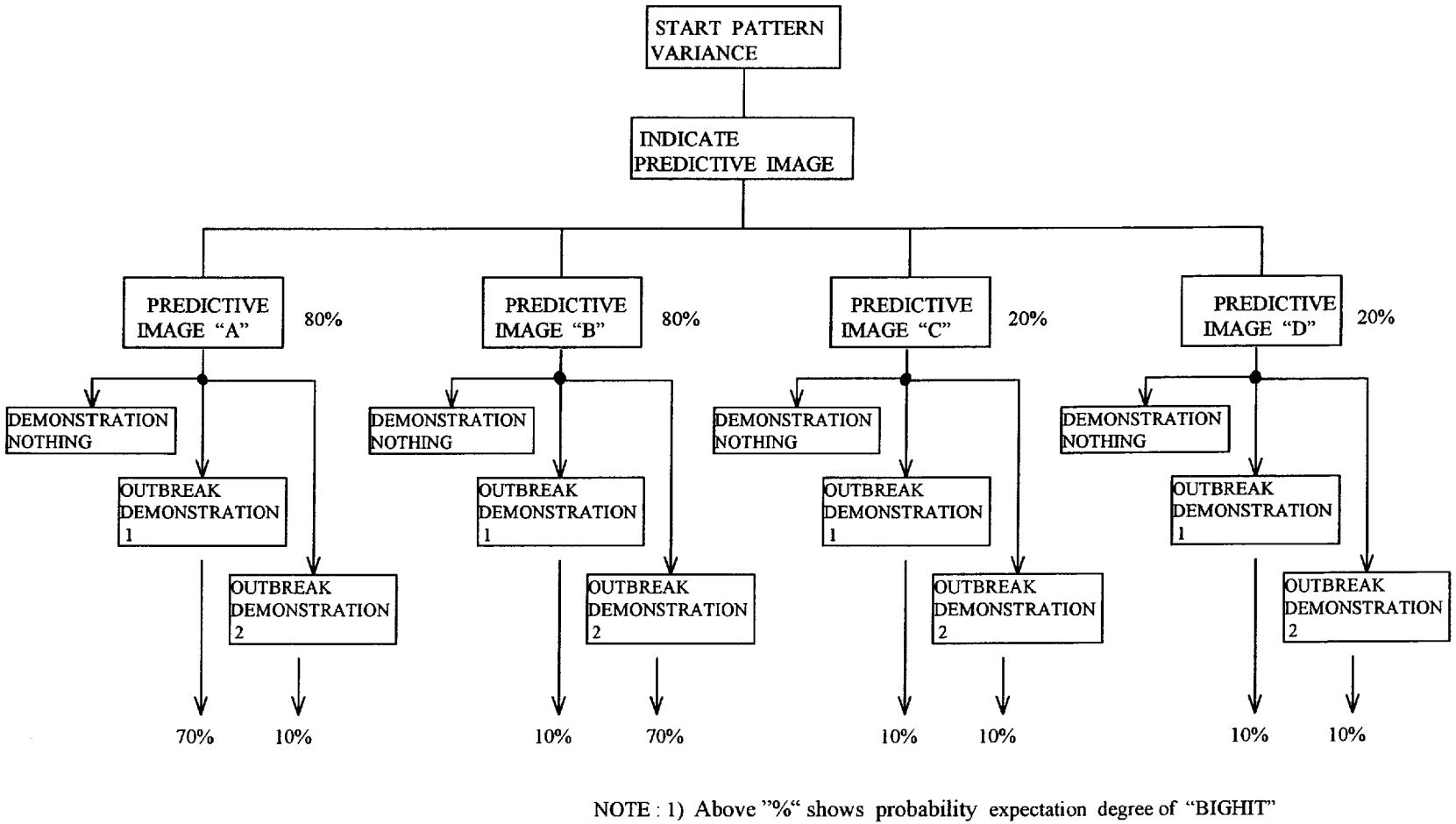
FIG. 7 is a block diagram that illustrates the degrees of expectation of the "big hit" represented by the combinations of predictive image and demonstration.

In this example, the degree of expectation for the indication of the special pattern (big hit) varies with the kind of the demonstration in addition to the predictive image. In FIG. 6 (I), for example, if the predictive image is "A", and "demonstration 1" is indicated successively, then the degree of expectation for the indication of the special pattern (big hit) is 70%. If "predictive image A" is indicated and "demonstration 2" is indicated successively, then the degree of expectation for the indication of the special pattern (big hit) is 10%. And, if "predictive image B" is indicated and "demonstration 1" is indicated successively, the degree of expectation for the indication of the special pattern (big hit) is 10%. If "predictive image B" is indicated and "demonstration 2" is indicated successively, then the degree of expectation for indication of special patter (big hit) is 70%. However, the degree of expectation for the indication of the special pattern (big hit) becomes 10% without relation to the demonstration indicated successively when "predictive image D is indicated. When such predictive images are indicated, the player is disappointed. FIG. 7 shows the expectation degree for "big hit" of player according to the predictive image correspondingly to FIG. 6. Accordingly, in addition to indication of the predictive image, a player can recognize the degree of expectation of the "big hit" associated with the special pattern that is indicated in the sequence by the indication of demonstration. A combination that includes the predictive image and the demonstration can vary the degree of expectation of the "big hit" and will realize may variations. The player can enjoy a game by looking for the predictive image and the demonstration that indicates the degree of expectation of the appearance of the "big hit" is high from the predictive image and demonstration indicated.

Next, an embodiment of the display for the game of this invention is applied and described as the display of a pachinko game machine.

Figure 8:
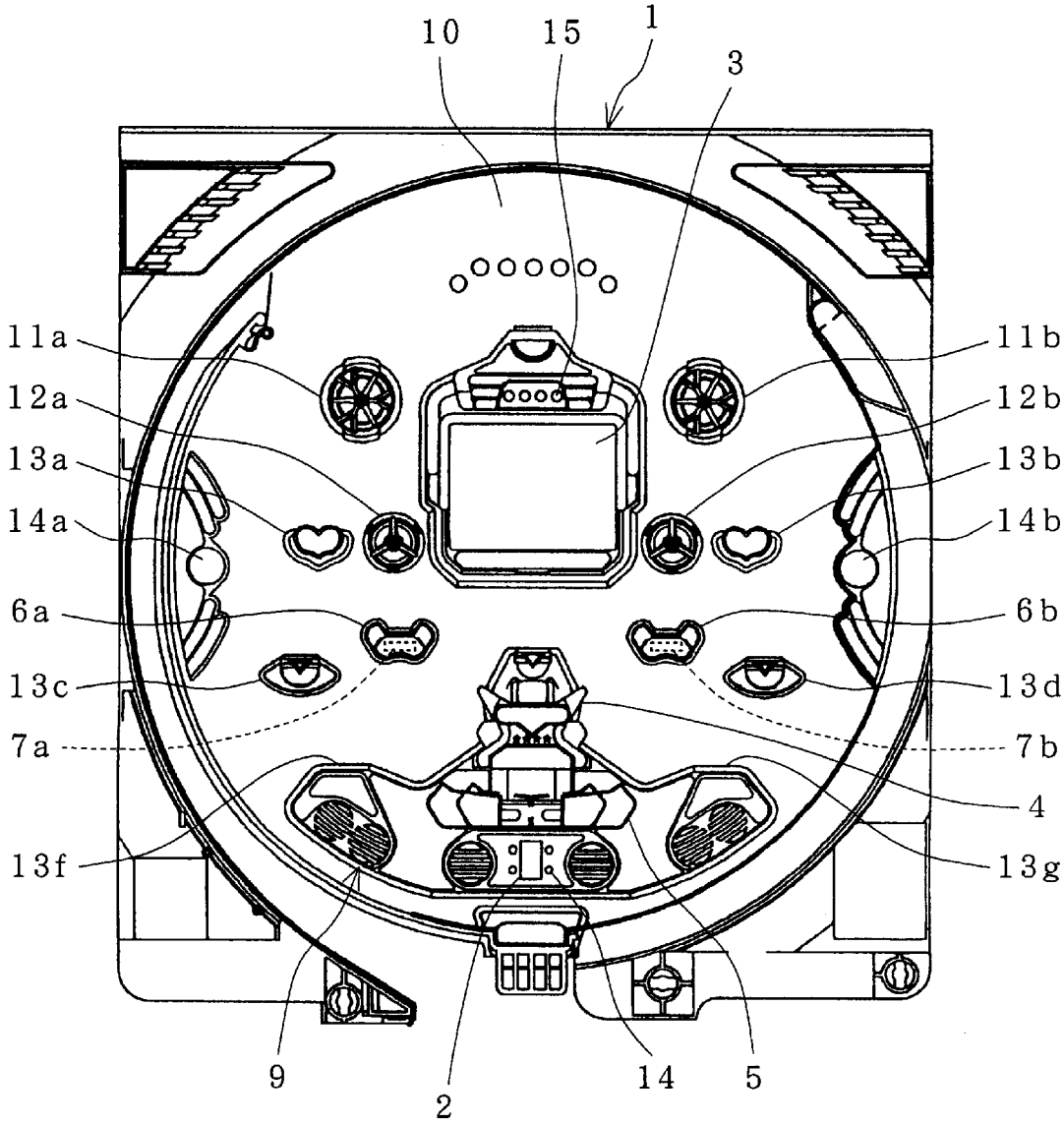
FIG. 8 is a front view of a game board surface of a pachinko gaming machine which includes a display of the invention.

FIG. 8 is a front view showing an example of game board surface of a pachinko gaming machine. The display for a game having the arrangement of FIG. 1, FIG. 2, FIG. 3 or FIG. 4 is used as the special pattern indication means in this pachinko gaming machine 1. The symbol display 301 consists of a special symbol display 3 in the gaming machine 1 of FIG. 8.

The special symbol display 3 consists of a liquid crystal display, and on the screen indicates "the special pattern" of the present invention by indicating a symbol on three rotatable reels according to electric signals. Also, electric indication devices, such as arranged LEDs, CRT, or plasma display can be sued as the special pattern display 3.

In a game board surface 10 of this pachinko gaming machine 1, two normal symbol operation gates 6*a*, 6*b* are provided in right and left of the lower portion of the special symbol display 3. In each gate 6*a*, 6*b*, tow normal symbol operation switches 7*a*, 7*b* are disposed and function to start a variable indication of a normal symbol display 2 because the normal symbol operation switch 7*a*, 7*b* detect the passage of a game ball.

Beneath the special pattern display 3 are disposed an arrangement for paying a predetermined number of (for example, five) prize balls at the time of the game ball entering thereunder, and a big prize hole 5 that has been configured to pay a predetermined number of (for example, fifteen) prize balls at the time of the game ball entering therein. The starter hole 4 consists of a variable winning prize device which is convertible between a first state that is disadvantageous for player and a second state that is advantageous for player. The starter hole 4 has a winning prize space where a game ball can enter even if the starter hole 4 is in the disadvantageous state. The big prize hole 5 consists of a changeable winning prize device which is convertible between a door closed stat that is disadvantageous for the player and a door opened state that is advantageous for the player.

A normal symbol display 2 is disposed in the lower part of the game board surface 10, and for normal symbol memory lamps 14 are provided in the outskirts. When the game ball enters the normal symbol operation gates 6*a*, 6*b* provided as an example of specified territory, the normal symbol memory lamps 14 turns on, and the lamps 14 indicate possible times of the symbol varying in the normal symbol display 2. That is the normal symbol memory lamps 14 memorize the number of the game balls up to four which entered the normal symbol operation gate 6*a* or 6*b* when the symbols of the normal symbol display 2 vary, and show the times of the normal display 2 being able to varying the symbols later on.

In addition, for special symbol memory laps 15 for indicating the times of the game ball entering the starter hole 4 during the display of varying special pattern are provided in the upper part of the special symbol display 3.

Furthermore, the game board surface 10 has also two lamp windmill 11*a*, 11*b* including light emitters, tow normal windmill 12*a*, 12*b*, usual winning holes 13*a*, 13*b*, 13*c* 13*d*, 13*f*, 13*g* determined for paying out fifteen prize balls every time the game ball enters, and side lamps 14*a*, 14*b*.

The normal symbol display 2, the starter hole 4, and the big prize hole 5 are integrally formed as a unit of variable winning prize ball device 9, the unit being disposed on the game board surface. The variable winning prize ball device 9, and the unit is disposed on the game board surface. The variable winning prize ball device 9 is provided with the general winning hole 13*f* and 13*g*. Further, a starter hole witch 31 (FIG. 9) is arranged to detect the game ball that has entered starter hole 4.

Figure 9:
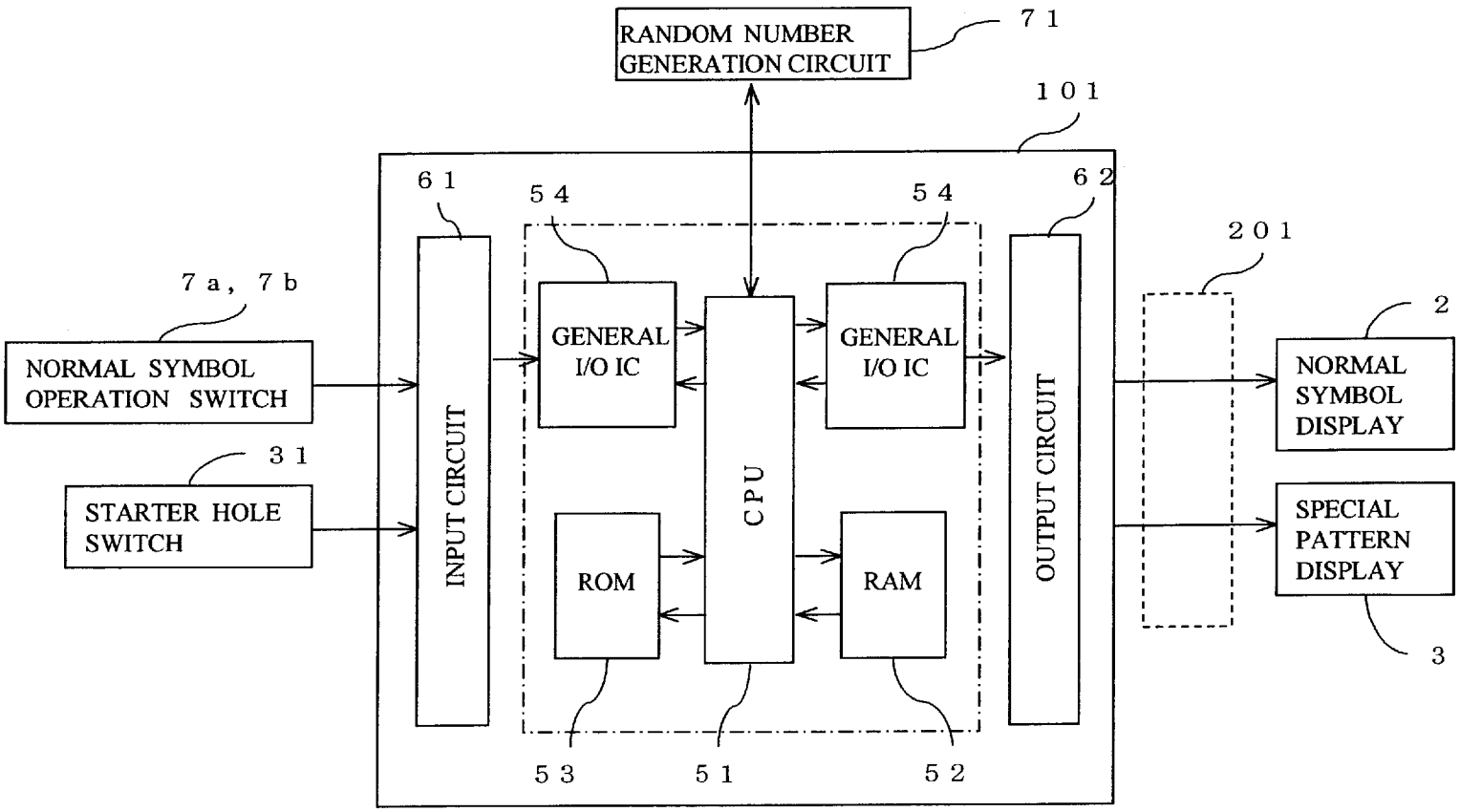
FIG. 9 is a block diagram that illustrates an electric circuit constitution of the pachinko gaming machine.

This pachinko gaming machine is provided with a microcomputer as controller, by which the whole game can be controlled. A controller of this embodiment machine is constituted mainly on a microcomputer as shown in FIG. 9.

Microcomputer 50 consist of CPU 51, RAM 52, ROM 53 and general-purpose I/O 54. It can process an input signal from input circuit 61 according a program that is stored in ROM 53, and send out an output signal from output circuit 62 to each drive means as required. Here, if a second controller 201 having the same construction as the microcomputer 50 is added as shown by a dashed line in FIG. 9, it results in a reduction of the burden on the CPU by sharing the burden or load over two CPUs because the control can be executed by the first and second controllers 101 and 102. As a random number generating means for generating random numbers used for processing the game and the display of this invention, a random number generation circuit 71 is connected to CPU 51. Random number generator 71 is not limited to the outside circuit connected to the CPU 51, but it may produce random numbers on programs contained in CPU 51.

As to means for generating input signals shown, the normal symbol operation switches 7*a* and 7*b* and the starter hole switch 31 are connected to the input circuit 61. The normal symbol display 2 and the special pattern display 3 are connected to the output circuit 62.

Figure 10:
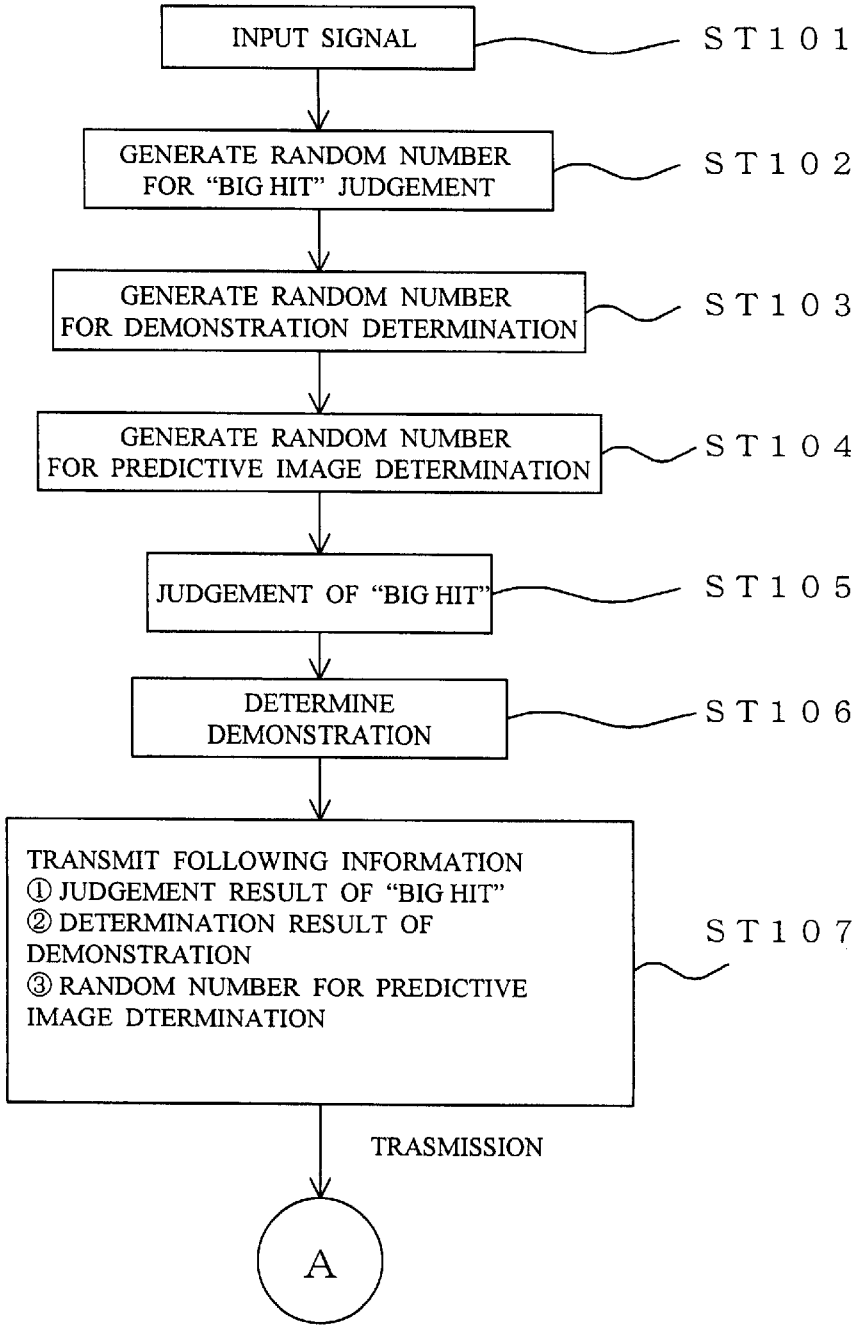
FIG. 10 is a flow chart that illustrates a procedure of the predictive image determination by a first controller.
Figure 11:
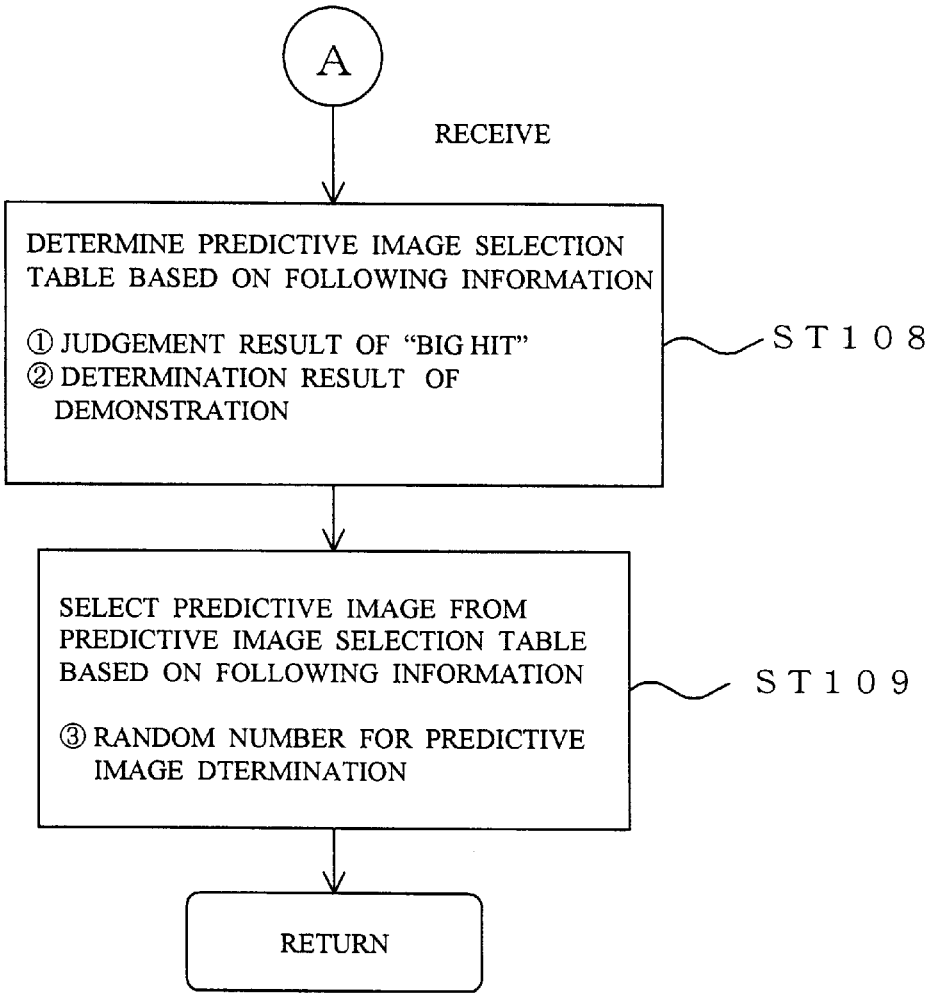
FIG. 11 is a flow chart that illustrates a procedure of the predictive image determination arrangement by a second controller.

FIG. 10 and FIG. 11 together show a process for determining the predictive image indicated by special pattern display 3 of the above pachinko gaming machine. An embodiment of the invention that executes processing by controller, specifically first controller 101 and the second controller 201 as shown in FIG. 4 will be described below. FIG. 10 shows a process flow diagram for use with the first controller 101, and FIG. 11 shows a further process flow diagram with the second controller 201. Here, the predictive image means image for predicting the state of profit given to player, and a degree of expectation for the appearance of the special pattern "big hit" are indicated by the predictive image as shown.

In the case of the pachinko gaming machine, the process of FIG. 10 is executed by CPU 51 of microcomputer 50 in FIG. 9. In the beginning, when an input signal (for example, a signal from the starter hole switch 31 to detect the game ball entered the starter hole 4) come (ST101), CPU 51 generates a random number (in FIG. 3, it is the first random number) necessary for determination of the special pattern to be stopped in a specified mode (ST102). Next, CPU 51 generates a random number (the second random number) to determine a "demonstration" that is a type of pattern standstill movement (ST103). Furthermore, CPU 51 generates a random number (the third random number) to determine the predictive image (ST104). A condition for generating the random number is not limited to an entering of the starter hole 4, but may constitute the entering into other winning holes and optionally may very according to the type or kind of gaming machine.

Next CPU 51 executes a "big hit" judgment process (ST105) and determines the demonstration (ST106). Here, demonstration determination means 105 determines the value of the random number generated in ST103 and the determination result in ST105. The determined date (i.e., the result of "big hit" judgment, the result of demonstration determination, and a random number for the predictive image determination) are transmitted to the second controller 201 (ST107).

FIG. 11 shows a process in the CPU of the second controller 201. The CPU selects a predictive image group form the predictive image selection table 206*a* in response to a combination of the judgment result of the "big hit" and the determination result of the random number for predictive image determination with the value range of the random number assigned to the predictive image group and determines the predictive image to be indicated (ST109). Then the process returns to the beginning of FIG. 10.

Next, an example of the indication process of the predictive image, the demonstration, and the special pattern, determined as mentioned above, will be explained.

Figure 12:
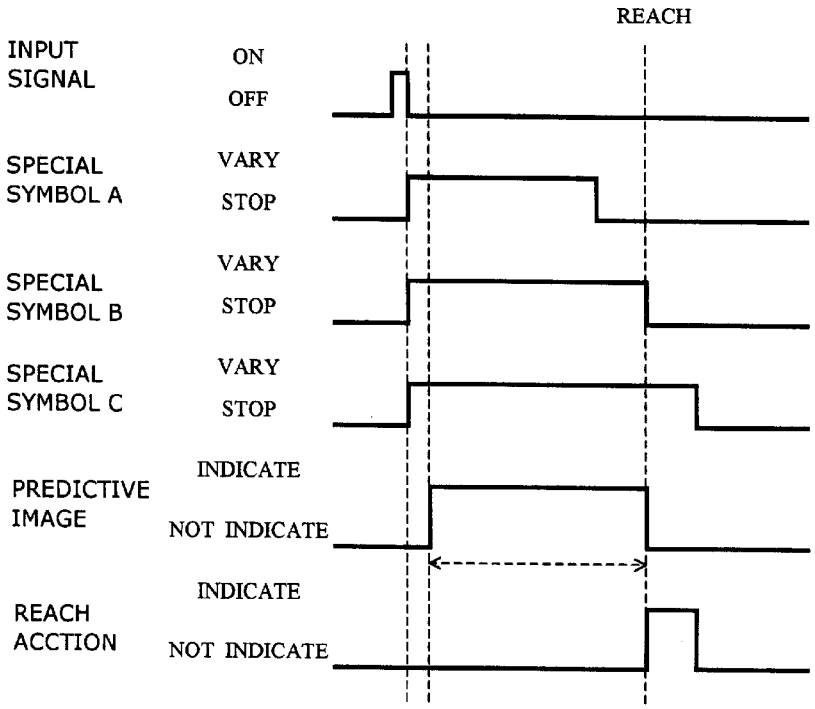
FIG. 12 is s timing chart that illustrates an example of the indication time of the predictive image, the demonstration and the special pattern.
Figure 13:
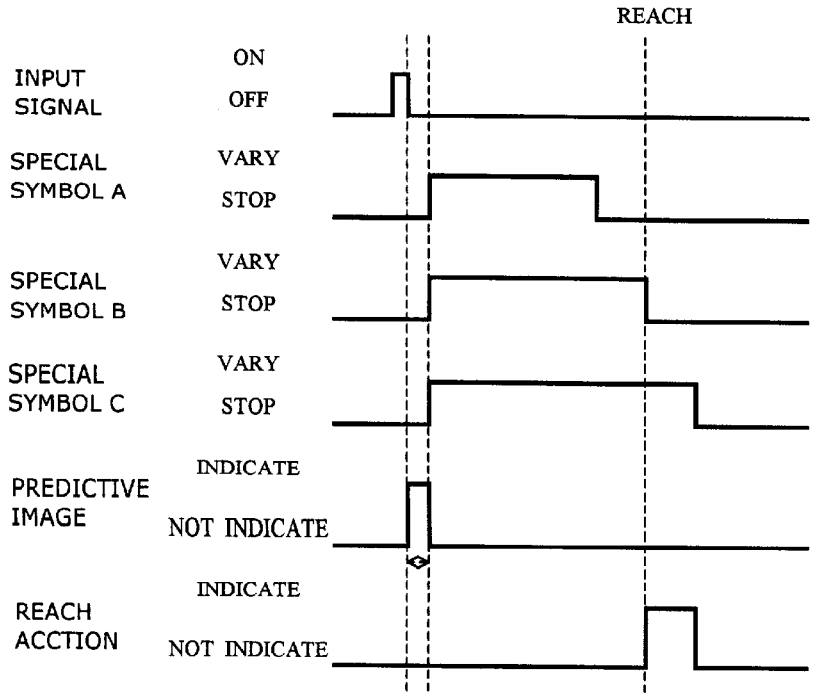
FIG. 13 is a timing chart that illustrates another example of the indication time of the predictive image, the demonstration, and the special pattern.
Figure 14:
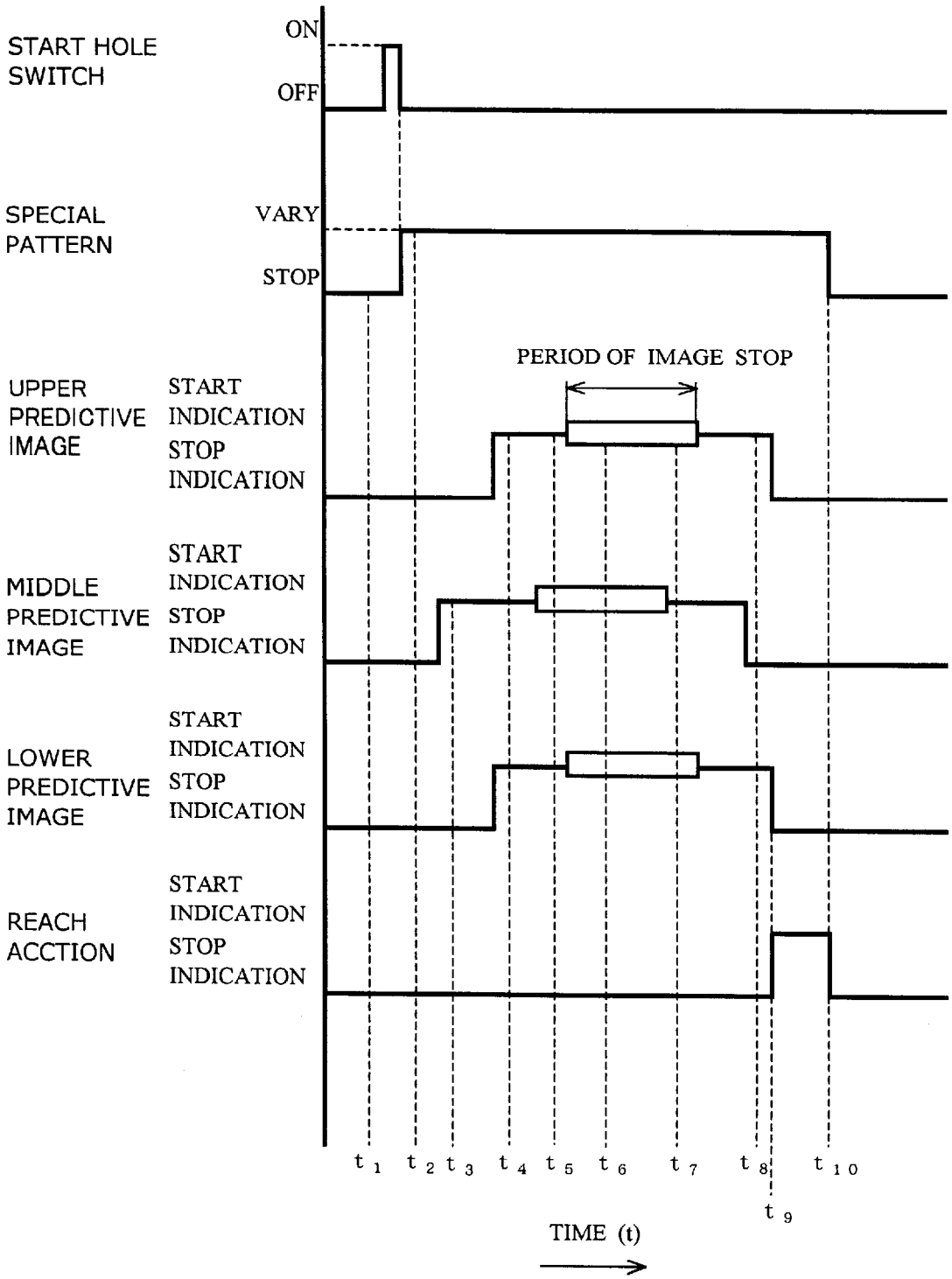
FIG. 14 is a timing chart that illustrates an example of the indication time of the predictive image indicated in three sites.

The top of each FIGS. 12 to 14 shows on and off (for example, ON and OFF of the starter hole switch) conditions of the input signal to start the variable indication of the special pattern, the second rank shows the timing of the start and the stop of the special pattern variable indication, the third rank shows the timing of the start and stop of the special pattern variable indication, the third rank shows the timing of the start and stop of the special pattern variable indication, the fourth rank shows the timing of the start and end of the demonstration indication. Though the following examples show some predictive images and demonstrations every time the varying special pattern is indicated, it is possible to show the predictive image and demonstration once after the varying special pattern is indicated twice or three times.

At first, in an example of FIG. 12, three lines of special symbols A, B, C (a special pattern consisting of three special symbols) start variable indication simultaneously when an input signal is generated, and after a predetermined time has passed, the first special symbol A, the next special symbol B, and the last special symbol C, respectively stoop. In this case, since the "reach" state generates when special symbol B stops at the same special symbol A after symbol A has stopped, the predictive image is indicated, or displayed, beginning when the indication of the varying special pattern is begun to when the reach is established and ending when special symbol C. stops.

In the example of FIG. 13, even if the input signal is generated, the variable indication of the three lines of special symbol A, B. C does not start immediately, but instead starts after a predetermined time. Here, the predictive image is indicated during a period beginning with the outbreak of the input signal to the start of the indication of the varying special symbol. The indication of the demonstration is similar to that shown in FIG. 12.

Next, in FIG. 14, the predictive image is indicated during the indication of the varying special pattern, as in FIG. 11. The special symbols appear at the upper, middle and lower positions of display (in the pachinko gaming machine of FIG. 8, a special pattern display 3).

Figure 15:
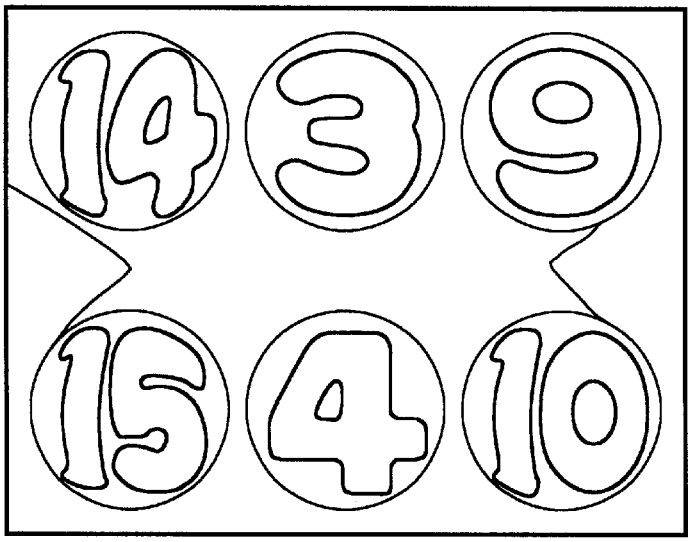
FIG. 15 is a representation that illustrates an indication state of a stopped special pattern in a screen.
Figure 16:
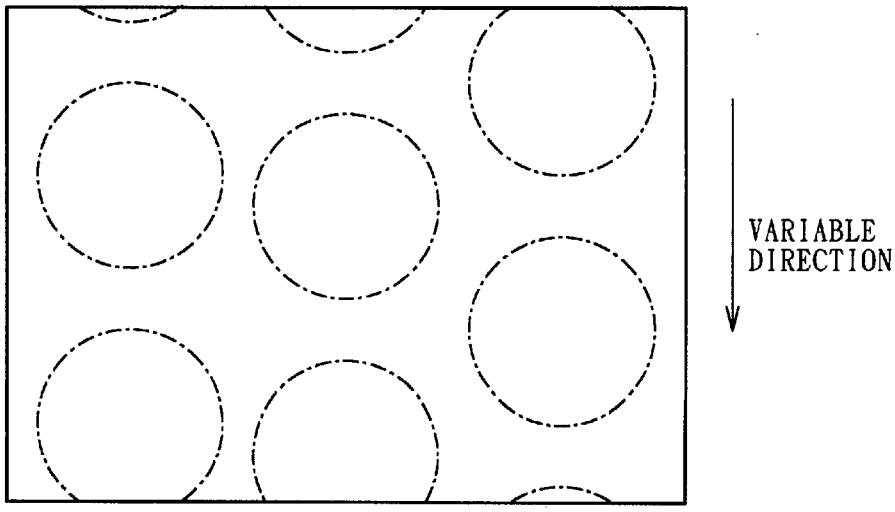
FIG. 16 is a representation that illustrates an indication state of a varying special pattern.

In this case, at the time (t1) when that the display does not display the varying indication in a state the gaming machine is switched on, as shown in FIG. 15, the special symbols of three lines are indicated in the state of "stop." In the screen of the display, for example, three columns of special symbol groups consisting of consecutive number 0–9 are indicated. In the example as shown, the display indicates "14-4-10" in the lower section of the screen. At this time, the display may indicate characters with no relation to the special pattern.

Next time t2, a variable indication of the special pattern has already begun in response to the "on" signal from the starter hole switch 31 in a direction of the downward arrow shown in FIG. 15, dotted line circles represent special patterns varying at a speed that a player cannot recognize.

Figure 18:
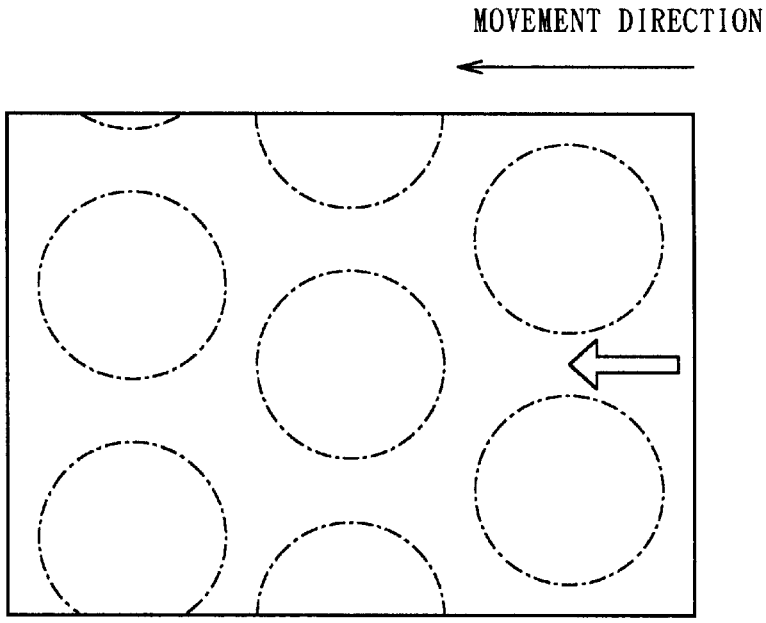
FIG. 18 is a representation that illustrates an indication state of the predictive images moving in a middle traverse direction of the screen.

Next, at time t3, the indication of the predictive image starts. The predictive images constitute the predictive image group by the combination of two symbols "arrow" and "star" as shown in FIGS. 17 (A) to (D). At this time t3, one of the predictive images, "arrow" appears in the middle section of the screen as shown in FIG. 18. The predictive image "arrow" moves left. In the following illustrative indication, a total of nine images are indicated in three sections, i.e., upper, middle and lower positions of the screen. However, the display may indicate images in two, four or more sections, or only one section of the screen.

Figure 19:
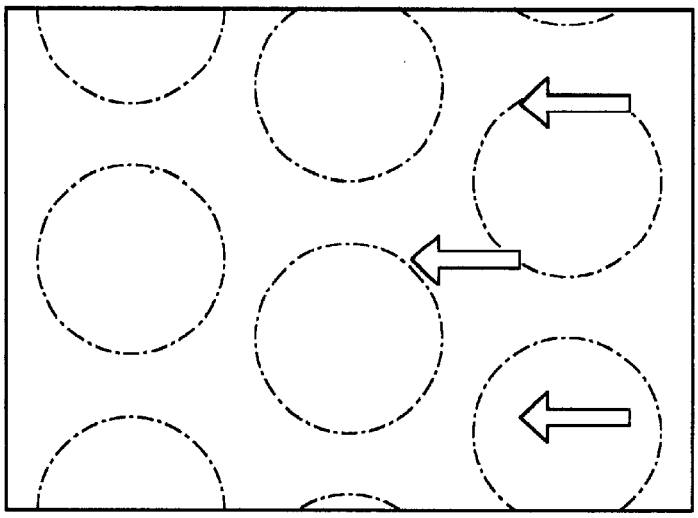
FIG. 19 is a representation that illustrates an indication state of the predictive images moving in a middle, and lower traverse direction of the screen.
Figure 20:
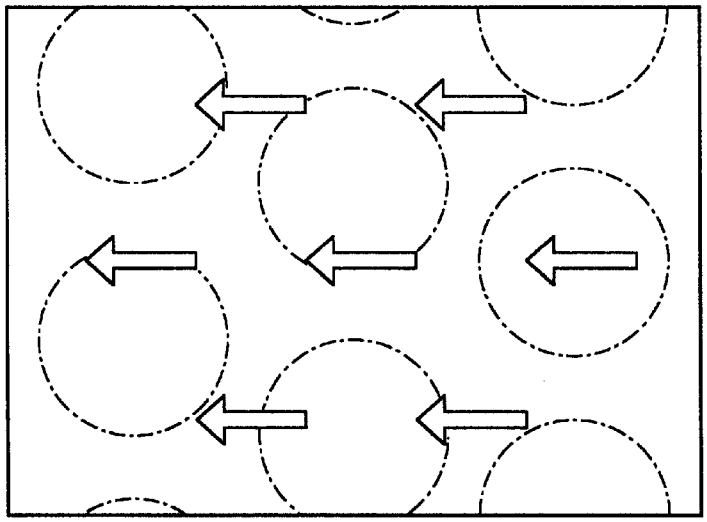
FIG. 20 is a representation that illustrates an indication state of the predictive images stopped in the middle traverse direction of the screen.

Next, at time t4, the predictive images of the upper and lower positions are indicated as shown in FIG. 19, then at time t5, when the three predictive images of the middle position stand in line as shown in FIG. 20, movement of the image stops only in the middle section. A player can recognize the images easily because the three images that stood in line in the middle section stop during a predetermined period. At this time, the images of the upper and lower sections are moving.

Figure 21:
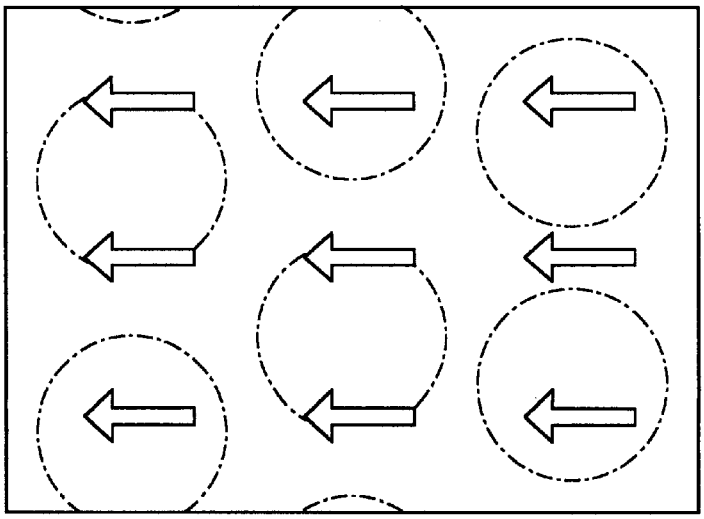
FIG. 21 is a representation that illustrates an indication state of the predictive images stopped in the upper, middle, and lower traverse directions of the screen.

After all three images are present as above, and a time (t6) when a total of nine images stand in line as shown in FIG. 21, the predictive image indication stops. The display continues to show the still images of each section of the screen for a predetermined period of time, the standstill time being adjustable to be set. In this way, by the non-moving indication of the nine images, a player can obtain information of the expectation degree for the indication of the special pattern to be stopped at the specified mode (for example, all three columns of special symbol groups stop at same number "2-2-2") which represents a "big hit", with correspondence to the demonstration indicated later.

Figure 22:
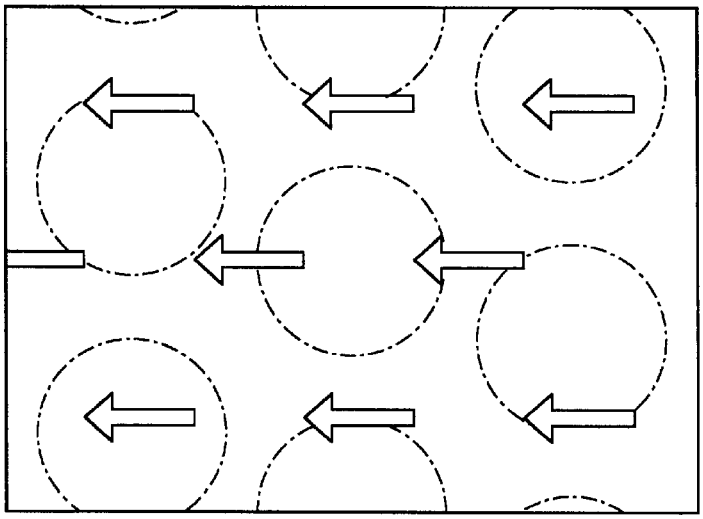
FIG. 22 is a representation that illustrates an indication state of the predictive images starting movement in the middle traverse direction of the screen.
Figure 23:
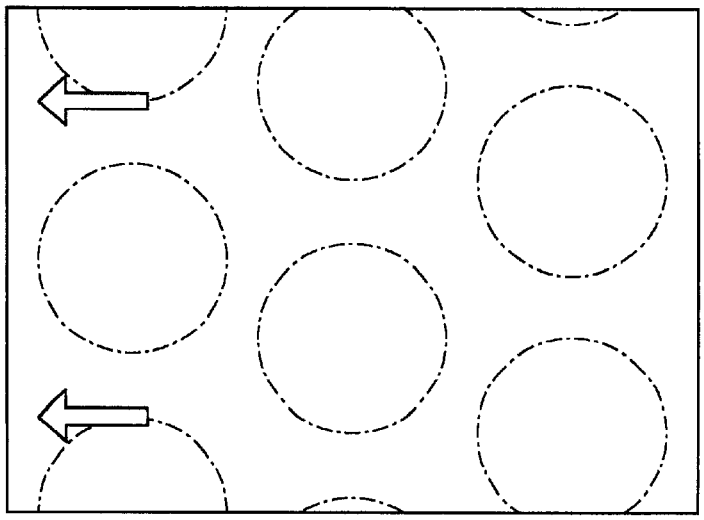
FIG. 23 is a representation that illustrates an indication state in which the predictive images are going to disappear in the upper and lower traverse directions after the predictive images have disappeared in the middle traverse direction of the screen.

When a predetermined time passes after indication of the predictive images stops as above, at time t7 of FIG. 14 the predictive images move to the left in the middle position as shown in FIG. 22, then the predictive images will disappear from the screen. Further, at time t8, the images of the upper and lower positions will move as shown in FIG. 23, and then the image will disappear, a demonstration is indicated on the screen and the varying special pattern will stop.

Figure 24:
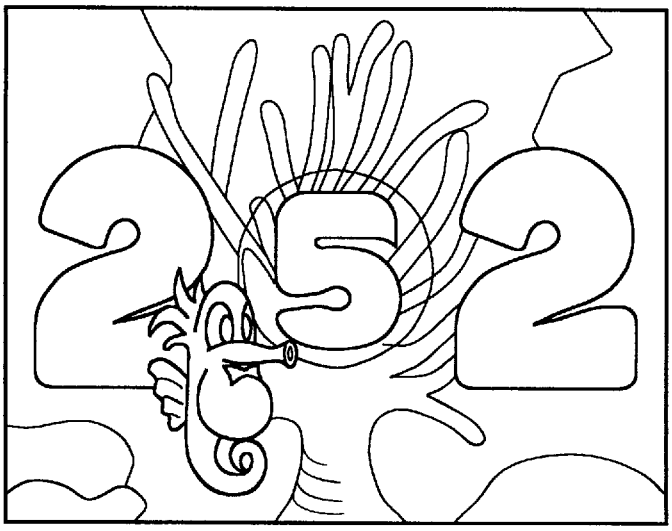
FIG. 24 is a representation that illustrates an example of the demonstration indication in the "reach" state of the special pattern.
Figure 25:
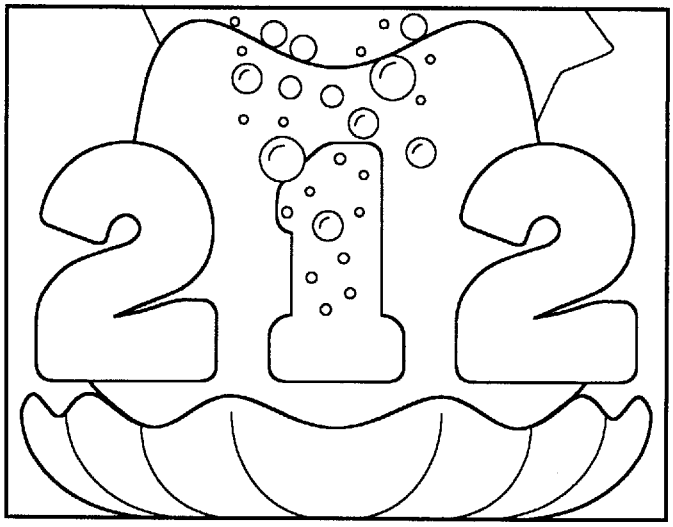
FIG. 25 is a representation that illustrates an example of the other demonstration indication.

In this way, when the demonstration determination means 105 determines the demonstration after indication of the predictive images, the demonstration is indicated for example, as shown in FIG. 24 or FIG. 25.

FIG. 24 shows the display screen representing the reach state of two special symbols "2" stopped in line in the middle position, corresponding to "demonstration 1" in FIG. 6. It shows the reach state in which right and left columns stop but a central column is varying. An image of "coral appears as the demonstration image in a background of the special patten, ant the demonstration image of a "sea horse" swimming from side-to side is indicated to be superimposed on the special pattern in a foreground of the special pattern.

FIG. 25 shows the display screen representing the reach state of two special symbols "2" stopped in line in the middle position as in FIG. 22 but the demonstration image is different from that of FIG. 22, corresponding to "demonstration 2" in FIG. 6. An image of a "shellfish" appears in a background of the special pattern. In this way, in the reach states, the indication of the demonstration image raise the interest level of player.

When there are two patterns (demonstration 1 and demonstration 2) of demonstration above, the predictive images as shown in FIG. 6 are determined according to a combination with on of the two patterns of demonstration and "big hit" or "loss." Hereafter, when the special pattern is stopped in the indication mode that indicates the specified game state (big hit), the big prize hole 5 is opened up to a predetermined multiple and a player can have a chance to get a large number f prize balls.

If the predictive images (FIGS. 17 (A) to (D)) correspond to A to D of FIG. 6, respectively, in the indication examples mentioned above, the degree of expectation for the appearance of the indication of the special pattern to be "big hit" such as "2-2-2" becomes 70% when "demonstration 1" (FIG. 21. In other words, the images of FIG. 21 are indicative of the degree of expectation of the "big hit" as well as the degree of expectation of a "loss" according to the kind of the demonstration. However, even if the display indicates the predictive images (for example, FIG. 17 (A) and FIG. 17(B) representing a high degree of expectation of a "big hit," a result of the game shall be a "loss" when the demonstration determination means 105 determines no demonstration.

A player can play three times the special game by the big prize hole 5 which is usually opened once as a special award when the special pattern indicates a "big hit." In this case, the special pattern is indicated to be varying again after the first game is over, and the player can obtain an advantageous game state in that the probability of a "big hit" is higher than usual.

Though the above-mentioned examples are used as display of a pachinko gaming machine, the display of this invention can be applied to the other gaming machines, for example, the slot machine having electric display, and TV game machine using other display devices.

Although the invention has been described in terms of specific embodiments and applications, persons skilled in the art can, in light of this teaching, generate additional embodiments without exceeding the scope or departing from the spirit of the claimed invention. Accordingly, it is to be understood that the drawing and description in this disclosure are proffered to facilitate comprehension of the invention, and should not be construed to limit the scope thereof.

What is claimed is:

1. A display for a game comprising:

a judgment arrangement for determining whether or not a specified game state is achieved in response to a predetermined input signal;

a special pattern determination arrangement for determining a special pattern that represents the specified game state;

a demonstration determination arrangement for determining a demonstration by selecting from a plurality of demonstrations that indicate display modes of respective stop motions that are different from a default stop motion of the special pattern;

a predictive image determination arrangement for determining a predictive image by selecting from a plurality of predictive images representing respective degrees of expectation of the appearance of the specified game state;

a display for displaying the special pattern, the demonstration and the predictive image determined by the special pattern determination arrangement, the demonstration determination arrangement and the predictive image determination arrangement, respectively; and a display controller for controlling the display to indicate the predictive image determined by the predictive image determination arrangement, then to indicate the demonstration determined by the demonstration determination arrangement, and to indicate the special pattern determined by the special pattern determination arrangement, wherein each of the plurality of demonstrations represents a respective degree of expectation of the appearance of the specified game state, the degree of expectation being varied according to a combination of the demonstration and the predictive image.

2. The display for a game according to claim 1, wherein the demonstration represents the degree of expectation of the appearance of a "big hit."

3. The display for a game according to claim 1, wherein the predictive image represents the degree of expectation of the appearance of a "big hit."

4. The display for a game according to claim 1, further comprising a memory for storing a plurality of predetermined symbols, wherein the special pattern determination arrangement produces the special pattern by combining the symbols stored in the memory according to the result of the determination made by the judgment arrangement.

5. The display for a game according to claim 4, wherein the memory stores a special pattern group consisting of a plurality of the special patterns, a demonstration image group consisting of a plurality of demonstration images required for displaying the demonstration, and a predictive image group consisting of a plurality of the predictive images, wherein;

the special pattern determination arrangement determines the special pattern to be displayed by selecting the special pattern corresponding to the result of the determination made by the judgment arrangement from the special pattern group, the demonstration determination arrangement determines the demonstration to be displayed by selecting the demonstration image corresponding to the result of the determination made by the judgment arrangement from the demonstration image group, and the predictive image determination arrangement determines the predictive image to be displayed by selecting the predictive image corresponding to the result of the determination made by the judgment arrangement from the predictive image group.

6. A display for a game comprising:

a judgment arrangement for determining whether or not a specified game state is achieved under a first condition in response to a predetermined input signal;

a special pattern determination arrangement for determining a special pattern to represent the specified game state based on a result of the determination made by the judgment arrangement;

a demonstration determination arrangement for determining a demonstration that is different from a default stop motion of the special pattern, based on the result of the determination made by the judgment arrangement and a second condition;

a predictive image determination arrangement for determining a predictive image to indicate a degree of expectation of the appearance of the specified game state, based on a result of the demonstration determination and a third condition;

a display for displaying the special pattern, the demonstration and the predictive image determined by the special pattern determination arrangement, the demonstration determination arrangement and the predictive image demonstration determination arrangement, respectively; and a display controller for controlling the display to indicate the predictive image determined by the predictive image determination arrangement, then the demonstration determined by the demonstration determination arrangement, and to indicate the special pattern determined by the special pattern determination arrangement.

7. The display for a game according to claim 6, wherein the first condition corresponds to the value of a first random number generated by a random number generator being coincident with a predetermined value.

8. The display for a game according to claim 6, wherein the second condition corresponds to the value of a second random number generated by a random number generator being coincident with a predetermined value.

9. The display for a game according to claim 6, wherein the third condition corresponds to the value of a third random number generated by a random number generator being coincident with a predetermined value.

10. The display for a game according to claim 6, wherein the first, second, and third conditions correspond to respective values of three random numbers generated in response to different input signals being coincident with predetermined values.

11. The display for a game according to claim 6, further comprising a memory for storing a plurality of predetermined symbols, wherein the special pattern determination arrangement produces the special pattern by combining the symbols stored in the memory according to the result of the determination made by the judgment arrangement.

12. The display for a game according to claim 11, wherein;

the memory stores a special pattern group consisting of a plurality of the special patterns, a demonstration image group consisting of a plurality of demonstration images required for displaying the demonstration, and a predictive image group consisting of a plurality of the predictive images, the special pattern determination arrangement determines the special pattern to be displayed by selecting the special pattern corresponding to the result of the determination made by the judgment arrangement from the special pattern group, the demonstration determination arrangement determines the demonstration to be displayed by selecting the demonstration image corresponding to the result of the determination made by the judgment arrangement and the second condition from the demonstration image group, and the predictive image determination arrangement determines the predictive image to be displayed by selecting the predictive image corresponding to the result of the determination made by the judgment arrangement and the third condition from the predictive image group.

13. A display for a game comprising:

a random number generator for generating three random numbers in response to a predetermined input signal;

a judgment arrangement for determining whether or not a specified game state is achieved, based on a first random number generated by the random number generator, a demonstration determination arrangement for determining a demonstration that is different from a default stop motion of a special pattern representing the specified game state, based on a result of the determination made by the judgment arrangement and a second random number generated by the random number generator, a special pattern selection table for storing a plurality of the special patterns;

a special pattern selection arrangement for selecting the special pattern to be displayed from the special pattern selection table, based on the result of the determination made by the judgment arrangement;

a demonstration image selection table for storing a plurality of demonstration images for displaying the demonstration;

a demonstration image selection arrangement for selecting the demonstration image required for displaying the demonstration determined by the demonstration determination arrangement from the demonstration image selection table;

a predictive image selection table for storing a plurality of predictive images representing respective degrees of expectation of the appearance of the specified game state;

a predictive image selection for selecting the predictive image to be displayed firm the predictive image selection table, based on the result of the demonstration and a third random number generated by the random number generator, a display for displaying the special pattern, the demonstration image and the predictive image determined by the special pattern selection arrangement, the demonstration image selection arrangement and the predictive image selection arrangement, respectively, and a display controller for controlling the display to display the predictive image selected by the predictive image selection, then the demonstration image selected by the demonstration image selection arrangement, and to display the special pattern selected by the special pattern selection arrangement.

14. The display for a game according to claim 13, wherein the predictive image selection table includes a plurality of selection tables in which the predictive images are assigned to random number ranges, respectively, the ranges being different each other corresponding to predetermined combinations of the result of the determination made by the judgment arrangement and the demonstration.

15. The display for a game according to claim 14, wherein the predictive image selection selects the selection table corresponding to the results of the determination made by the judgment arrangement and the demonstration determination arrangement, and selects the predictive image to be displayed according to the random number range of the selected table in which a value of the third random number belongs.

16. A gaming machine comprising:

a judgment arrangement for determining whether or not a specified game state is achieved in response to a predetermined input signal;

a special pattern determination arrangement for determining a special pattern to represent the specified game state;

a demonstration determination arrangement for determining a demonstration by selecting from a plurality of demonstrations that indicate display modes of respective stop motions that are different from a default stop motion of the special pattern;

a predictive image determination arrangement for determining a predictive image by selecting from a plurality of predictive images representing respective degrees of expectation of the specified game state;

a display for displaying the special pattern the demonstration and the predictive image determined by the special pattern determination arrangement, the demonstration determination arrangement and the predictive image determination arrangement, respectively; and a display controller for controlling the display to indicate the predictive image determined by the predictive image determination arrangement, then the demonstration determined by the demonstration determination arrangement, and to indicate the special pattern determined by the special pattern determination arrangement, wherein each of the plurality of demonstrations represents a degree of expectation of the appearance of the specified game state, the degree of expectation being varied according to a combination of the demonstration and the predictive image.

17. A gaming machine comprising:

a judgment arrangement for determining whether or not a specified game state is achieved under a first condition in response to a predetermined input signal;

a special pattern determination arrangement for determining a special pattern to represent the specified game state based on a result of the determination made by the judgment arrangement;

a demonstration determination arrangement for determining a demonstration that is different from a default stop motion of the special pattern, based on the result of the determination made by the judgment arrangement and a second condition;

a predictive image determination arrangement for determining a predictive image to indicate an expectation degree in appearance of the specified game state, based on a result of the demonstration determination and a third condition;

a display for displaying the special pattern, the demonstration and the predictive image determined by the special pattern determination arrangement, the demonstration determination arrangement and the predictive image determination arrangement, respectively; and a display controller for controlling the display to indicate the predictive image determined by the predictive image determination arrangement, then the demonstration determined by the demonstration determination arrangement, and to indicate the special pattern determined by the special pattern determination arrangement.

18. The gaming machine according to claim 17, which further comprises a memory for storing a plurality of predetermined symbols, and in which the special pattern determination arrangement produces the special pattern by combining the symbols stored in the memory corresponding to the result of the determination made by the judgment arrangement.

19. The gaming machine according to claim 18, wherein the memory stores a special pattern group consisting of a plurality of the special patterns, a demonstration image group consisting of a plurality of demonstration images required for displaying the demonstration, and a predictive image group consisting of a plurality of the predictive images, wherein:

the special pattern determination arrangement determines the special pattern to be displayed by selecting the special pattern corresponding to the result of the determination made by the judgment arrangement from the special pattern group, the demonstration determination arrangement determines the demonstration to be displayed by selecting the demonstration image corresponding to the result of the determination made by the judgment arrangement from the demonstration image group, and the predictive image determination arrangement determines the predictive image to be displayed by selecting the predictive image corresponding to the result of the determination made by the judgment arrangement from the predictive image group.

20. A gaming machine comprising:

a random number generator for generating three random numbers in response to a predetermined input signal;

a judgment arrangement for determining whether or not a specified game state is achieved, based on a first random number generated by the random number generator, a demonstration determination arrangement for determining a demonstration that is different from a default stop motion of a special pattern representing the specified game state, based on a result of the determination made by the judgment arrangement and a second random number generated by the random number generator, a special pattern selection table for storing a plurality of the special patterns;

a special pattern selection arrangement for selecting the special pattern to be displayed from the special pattern selection table, based on the result of the determination made by the judgment arrangement;

a demonstration image selection table for storing a plurality of demonstration images required for displaying the demonstration;

a demonstration image selection arrangement for selecting the demonstration image required for displaying the demonstration determined by the demonstration determination arrangement from the demonstration image selection table;

a predictive image selection table for storing a plurality of predictive images representing respective degrees of expectation of the appearance of the specified game state;

a predictive image selection for selecting the predictive image to be displayed from the predictive image selection table, based on the result of the demonstration determination and a third random number generated by the random number generator, a display for displaying the special pattern, the demonstration image and rite predictive image determined by the special pattern selection arrangement, the demonstration image selection arrangement and the predictive image selection arrangement, respectively; and a display controller for controlling the display to display the predictive image selected by the predictive image selection, then the demonstration image selected by the demonstration image selection arrangement, and to display the special pattern selected by the special pattern selection arrangement.

* * * * *